US010620564B2

(12) United States Patent
Koga et al.

(10) Patent No.: US 10,620,564 B2
(45) Date of Patent: Apr. 14, 2020

(54) DEVELOPING DEVICE HAVING A REGULATING BLADE OF RESIN

(71) Applicant: CANON KABUSHIKI KAISHA, Tokyo (JP)

(72) Inventors: Shunichi Koga, Abiko (JP); Teruaki Tsurusaki, Moriya (JP); Tomohiro Shiomi, Abiko (JP); Jun Kawakita, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/183,973

(22) Filed: Nov. 8, 2018

(65) Prior Publication Data

US 2019/0155187 A1 May 23, 2019

(30) Foreign Application Priority Data

Nov. 22, 2017 (JP) ..... 2017-224976
Nov. 22, 2017 (JP) ..... 2017-224977
Oct. 5, 2018 (JP) ..... 2018-190016

(51) Int. Cl.
*G03G 15/08* (2006.01)
*G03G 15/09* (2006.01)

(52) U.S. Cl.
CPC ..... *G03G 15/081* (2013.01); *G03G 15/0812* (2013.01); *G03G 2221/1654* (2013.01)

(58) Field of Classification Search
CPC ..... G03G 15/081; G03G 15/0812
(Continued)

(56) References Cited

U.S. PATENT DOCUMENTS 5,853,868 A * 12/1998 Bracken et al. ... G03G 15/0812 399/284
6,282,395 B1 * 8/2001 Nittani et al. ..... G03G 15/0812 399/274

(Continued)

FOREIGN PATENT DOCUMENTS

EP 2 602 670 A1 6/2013
JP H08-160743 A 6/1996

(Continued)

OTHER PUBLICATIONS

Shunichi Koga et al., U.S. Appl. No. 16/202,261, filed Nov. 28, 2018.

(Continued)

*Primary Examiner* — William J Royer
(74) *Attorney, Agent, or Firm* — Venable LLP

(57) ABSTRACT

When a developing device including a developer carrying member, a regulating blade, and a developing device frame including first and second ribs is seen in a cross section perpendicular to a rotational axis of the developer carrying member, the first and second ribs are provided at a predetermined gap in a direction from a position where the regulating blade is closest to the developer carrying member toward a rotation center of the developer carrying member. The first and second ribs have first and second supporting surfaces, respectively, each supporting the regulating blade and having a width of 3.0 mm or less. In a state that the regulating blade is supported by the first and second supporting surfaces, the regulating blade is fixed to the mounting portion in a region of the regulating blade corresponding to a maximum image region of an image bearing member.

20 Claims, 23 Drawing Sheets

(58) Field of Classification Search
USPC ..... 399/274, 284
See application file for complete search history.

(56) References Cited

U.S. PATENT DOCUMENTS

| | | | |
|---|---|---|---|
| 9,372,437 | B2 | 6/2016 | Yasumoto et al. |
| 9,921,520 | B2 | 3/2018 | Yasumoto et al. |
| 2015/0043950 | A1 | 2/2015 | Yasumoto et al. |
| 2018/0157191 | A1 | 6/2018 | Yasumoto et al. |

FOREIGN PATENT DOCUMENTS

| | | | |
|---|---|---|---|
| JP | 2010-134257 | A | 6/2010 |
| JP | 2014-197175 | A | 10/2014 |
| JP | 2017-203814 | A | 11/2017 |

OTHER PUBLICATIONS

Tomohiro Shiomi et al., U.S. Appl. No. 16/113,371, filed Aug. 27, 2018.
European Search Report dated Feb. 8, 2019, in related European Patent Application No. 18205335.5.

* cited by examiner

DEVELOPING DEVICE HAVING A REGULATING BLADE OF RESIN

FIELD OF THE INVENTION AND RELATED ART

The present invention relates to a developing device including a resin-made regulating blade.

The developing device includes a developing device frame, a rotatable developer carrying member for carrying a developer in order to develop an electrostatic latent image formed on an image bearing member, and a regulating blade as a developer regulating member for regulating an amount of the developer carried on the developer carrying member. The regulating blade is provided opposed to the developer carrying member with a predetermined gap between itself and the developer carrying member over a direction parallel to a rotational axis of the developer carrying member (hereinafter, the gap is referred to as an SB gap). The SB gap refers to a minimum distance between the developer carrying member and the regulating blade. By adjusting a magnitude of this SB gap, an amount of the developer fed to a developing region where the developer carrying member opposes an image bearing member is adjusted.

In recent years, a developing device including a resin-made developer regulating member (regulating blade) prepared by molding a resin material and a resin-made developing device frame prepared by molding a resin material has been known (Japanese Laid-Open Patent Application (JP-A) 2014-197175).

In the developing device including the resin-made regulating blade and the resin-made developing device frame, it would be considered that the resin-made regulating blade is mounted and fixed to a blade mounting portion of the resin-made developing device frame.

Corresponding to an increase in width of a sheet on which an image is formed, a longitudinal length of the regulating blade in a region (maximum image region of the regulating blade) corresponding to a maximum image region of an image region in which the image is formable on the image bearing member increases. Further, correspondingly to an increase in longitudinal length of the regulating blade in the maximum image region, a longitudinal length of a surface of the blade mounting portion of the developing device frame on which the regulating blade is mounted (hereinafter, this surface is referred to as a blade mounting surface) increases.

In the case where the developing device frame having the blade mounting surface which has a large (long) longitudinal length is molded with a resin material, a degree of unevenness of the blade mounting surface of the developing device frame is liable to increase, so that there is a tendency that flatness (JIS B0021) of the blade mounting surface of the developing device frame becomes large. This is because in general, with an increasing longitudinal length of a resin molded product, a variation in flatness of the resin molded product with respect to a longitudinal direction is liable to occur.

In the case where the flatness of the blade mounting surface of the developing device frame is large, a magnitude of an SB gap in a state that the regulating blade is mounted on the blade mounting portion of the developing device frame having large flatness has a tendency that the magnitude of the SB gap is liable to be different with respect to a longitudinal direction of the developer carrying member. When the magnitude of the SB gap is different with respect to the longitudinal direction of the developer carrying member, there is a liability that an amount of a developer carried on a surface of the developer carrying member causes unevenness with respect to the longitudinal direction of the developer carrying member. For this reason, in the case where the resin-made regulating blade is fixed to the resin-made developing device frame having the large longitudinal length of the blade mounting surface of the developing device frame, in order to cause the magnitude of the SB gap to fall within a predetermined range over the longitudinal direction of the developer carrying member, it is required that the flatness of the blade mounting surface of the developing device frame is made small.

In the case where the resin-made developing device frame having the large longitudinal length of the blade mounting surface thereof is manufactured with accuracy of a general-purpose resin molded product, in order to make the flatness of the blade mounting surface of the developing device frame small, it would be considered that a length of the blade mounting surface of the developing device frame with respect to a widthwise direction of the developing device frame is made a predetermined value or less. Therefore, in the case where the resin-made regulating blade is fixed to the resin-made developing device frame having the length, of the blade mounting surface of the developing device frame with respect to the widthwise direction, which is the predetermined value or less, it is required that an attitude of the regulating blade mounted on the blade mounting surface of the developing device frame when the regulating blade is fixed to the developing device frame is stabilized.

A first invention has been accomplished in view of the above-described problem. A principal object of the first invention is to provide a developing device capable of stabilizing an attitude of a regulating blade mounted on a blade mounting surface of a developing device frame when the regulating blade made of a resin material is fixed to the developing device frame made of a resin material while decreasing flatness of the blade mounting surface of the developing device frame made of the resin material, by a simple constitution.

Similarly, in the case where the regulating blade having a large (long) longitudinal length in a maximum image region thereof is molded with a resin material, a degree of unevenness of a surface of the regulating blade to be mounted on the developing device frame (hereinafter, this surface is referred to as a surface-to-be-mounted) is liable to increase, so that there is a tendency that flatness (JIS B0021) of the surface-to-be-mounted of the regulating blade becomes large.

In the case where the flatness of the surface-to-be-mounted of the regulating blade is large, a magnitude of an SB gap in a state that the surface-to-be-mounted of the regulating blade is mounted on the developing device frame having large flatness has a tendency that the magnitude of the SB gap is liable to be different with respect to a longitudinal direction of the developer carrying member. Therefore, in the case where the resin-made regulating blade having the large longitudinal length thereof in the maximum image region of the regulating blade is fixed to the resin-made developing device frame, in order to cause the magnitude of the SB gap to fall within a predetermined range over the longitudinal direction of the developer carrying member, it is required that the flatness of the surface-to-be-mounted of the regulating blade is made small.

In the case where the resin-made regulating blade having the large longitudinal length thereof in the maximum image region is manufactured with accuracy of a general-purpose resin molded product, in order to make the flatness of the surface-to-be-mounted of the regulating blade small, it would be considered that a length of the surface-to-be-mounted of the regulating blade with respect to a widthwise direction of the regulating blade is made a predetermined value or less. Therefore, in the case where the resin-made regulating blade having the length, of the surface-to-be-mounted of the regulating blade with respect to the widthwise direction, which is the predetermined value or less is fixed to the resin-made developing device frame, it is required that an attitude of the regulating blade mounted at the surface-to-be-mounted of the regulating blade on the developing device frame when the regulating blade is fixed to the developing device frame is stabilized.

A second invention has been accomplished in view of the above-described problem. A principal object of the second invention is to provide a developing device capable of stabilizing an attitude of a regulating blade mounted at a surface-to-be-mounted of the regulating blade on a developing device frame when the regulating blade made of a resin material is fixed to the developing device frame made of a resin material while decreasing flatness of the surface-to-be-mounted of the regulating blade made of the resin material, by a simple constitution.

Further, in a constitution in which the regulating blade made of the resin material is mounted on the blade mounting portion of the developing device frame made of the resin material and is fixed to the blade mounting portion of the developing device frame with an adhesive, the adhesive having a predetermined film thickness is applied onto, for example, a blade mounting surface of the developing device frame. Then, when the regulating blade is mounted on the blade mounting portion of the developing device frame, in order to cause the regulating blade to be adhesively bonded to the blade mounting portion of the developing device frame, predetermined pressure is exerted on the regulating blade. At this time, the adhesive having the predetermined film thickness is deformed, so that there is a liability that the adhesive (excessive adhesive) escaping to an outside of a surface on which the adhesive is applied enters an inside of the developing device frame. In the case where this excessive adhesive is especially deposited on a guiding portion (developer guiding portion) for guiding the developer so as to be fed toward the SB gap and then is cured, there is a liability that a flow of the developer fed toward the SB gap fluctuates. In such a case, there is a liability that an amount of a developer carried on a surface of the developer carrying member causes unevenness with respect to the longitudinal direction of the developer carrying member.

A third invention has been accomplished in view of the above-described problem. A principal object of the third invention is to provide a developing device capable of suppressing entrance of the adhesive into the developing device frame when the regulating blade made of a resin material is mounted on the blade mounting portion in a constitution in which the regulating blade is mounted on the blade mounting portion of the developing device frame made of the resin material and then is fixed with the adhesive.

SUMMARY OF THE INVENTION

A principal object of the first invention is to stabilize an attitude of a regulating blade mounted on a blade mounting surface of a developing device frame when the regulating blade made of a resin material is fixed to the developing device frame made of a resin material while decreasing flatness of the blade mounting surface of the developing device frame made of the resin material, by a simple constitution.

According to an aspect of the present invention, there is provided a developing device comprising: a rotatable developer carrying member configured to carry a developer comprising toner and a carrier for developing an electrostatic latent image formed on an image bearing member; a regulating blade made of a resin material and provided opposed to the rotatable developer carrying member in non-contact with the rotatable developer carrying member, the regulating blade being configured to regulate an amount of the developer carried on the rotatable developer carrying member; and a developing device frame provided separately from the regulating blade and including a mounting portion configured to mount the regulating blade, wherein the developing device frame includes a first rib and a second rib which project from the mounting portion and which support the regulating blade, the first rib and the second rib extending along a rotational axis direction of the developer carrying member over a substantially entire region of the mounting portion corresponding to a maximum image region of the image bearing member in which an image is capable of forming, wherein when the developing device is seen in a cross section perpendicular to a rotational axis of the developer carrying member, the first rib and the second rib are provided at a predetermined gap therebetween in a direction from a position where the regulating blade is closest to the developer carrying member toward a rotation center of the developer carrying member, and the first rib has a first supporting surface supporting the regulating blade, and the second rib has a second supporting surface supporting the regulating blade, each of the first supporting surface and the second supporting surface having a width of 3.0 mm or less, and wherein in a state that the regulating blade is supported by both of the first supporting surface and the second supporting surface, the regulating blade is fixed to the mounting portion in a region of the regulating blade corresponding to the maximum image region of the image bearing member.

A principal object of the second invention is to stabilize an attitude of a regulating blade mounted at a surface-to-be-mounted of the regulating blade on a developing device frame when the regulating blade made of a resin material is fixed to the developing device frame made of a resin material while decreasing flatness of the surface-to-be-mounted of the regulating blade made of the resin material, by a simple constitution.

According to another aspect of the present invention, there is provided a developing device comprising: a rotatable developer carrying member configured to carry a developer comprising toner and a carrier for developing an electrostatic latent image formed on an image bearing member; a regulating blade made of a resin material and provided opposed to the rotatable developer carrying member in non-contact with the rotatable developer carrying member, the regulating blade being configured to regulate an amount of the developer carried on the rotatable developer carrying member and including a base portion and a regulating portion which is provided at a position thereof closest to the regulating blade and which is configured to regulate the amount of the developer carried on the rotatable developer carrying member; and a developing device frame provided separately from the regulating blade and including a mounting portion configured to mount the regulating blade, wherein the regulating blade includes a first rib and a second rib which project from the base portion and which are supported by the mounting portion, the first rib and the second rib extending along a rotational axis direction of the developer carrying member over a substantially entire region of the base portion corresponding to a maximum image region of the image bearing member in which an image is capable of forming, wherein when the developing device is seen in a cross section perpendicular to a rotational axis of the developer carrying member, the first rib and the second rib are provided at a predetermined gap therebetween in a direction from a position where the regulating blade is closest to the developer carrying member toward a rotation center of the developer carrying member, and the first rib has a first surface to be supported by the mounting portion, and the second rib has a second surface to be supported by the mounting portion, each of the first surface to be supported and the second surface to be supported having a width of 3.0 mm or less, and wherein in a state that both of the first surface to be supported and the second surface to be supported are supported by the mounting portion, the regulating blade is fixed to the mounting portion in a region of the regulating blade corresponding to the maximum image region of the image bearing member.

A principal object of the third invention is to suppress entrance of the adhesive into the developing device frame when the regulating blade made of a resin material is mounted on the blade mounting portion in a constitution in which the regulating blade is mounted on the blade mounting portion of the developing device frame made of the resin material and then is fixed with the adhesive.

According to another aspect of the present invention, there is provided a developing device comprising: a rotatable developer carrying member configured to carry a developer comprising toner and a carrier for developing an electrostatic latent image formed on an image bearing member; a regulating blade made of a resin material and provided opposed to the rotatable developer carrying member in non-contact with the rotatable developer carrying member, the regulating blade being configured to regulate an amount of the developer carried on the rotatable developer carrying member; and a developing device frame provided separately from the regulating blade and including a mounting portion configured to mount the regulating blade, wherein the regulating blade is fixed to the mounting portion with an adhesive in a region thereof corresponding to a maximum image region of the image bearing member in which an image is capable of forming, wherein when the developing device is seen in the cross section perpendicular to the rotational axis of the developer carrying member, a predetermined space for storing the adhesive is formed between the mounting portion and the regulating blade, and wherein the predetermined space is formed in a region of the mounting portion corresponding to the maximum image region of the image bearing member.

According to a further aspect of the present invention, there is provided a developing device comprising: a rotatable developer carrying member configured to carry a developer comprising toner and a carrier for developing an electrostatic latent image formed on an image bearing member; a regulating blade made of a resin material and provided opposed to the rotatable developer carrying member in non-contact with the rotatable developer carrying member, the regulating blade being configured to regulate an amount of the developer carried on the rotatable developer carrying member; and a developing device frame provided separately from the regulating blade and including a mounting portion configured to mount the regulating blade, wherein the regulating blade is fixed to the mounting portion with an adhesive in a region thereof corresponding to a maximum image region of the image bearing member in which an image is capable of forming, wherein when the developing device is seen in the cross section perpendicular to the rotational axis of the developer carrying member, a predetermined space for storing the adhesive is formed between the mounting portion and the regulating blade, and wherein the predetermined space is formed in a region of the regulating blade corresponding to the maximum image region of the image bearing member.

Further features of the present invention will become apparent from the following description of exemplary embodiments with reference to the attached drawings.

DESCRIPTION OF EMBODIMENTS

Embodiments of the invention will be specifically described with reference to the drawings. Incidentally, the following embodiments do not limit the present invention according to the claims, and all combinations of features described in a First Embodiment are not necessarily essential to means for solving a problem of the present invention. The present invention can be carried out in various uses such as printers, various printing machines, facsimile machines and multi-function machines.

First Embodiment (Structure of Image Forming Apparatus)

Figure 1:
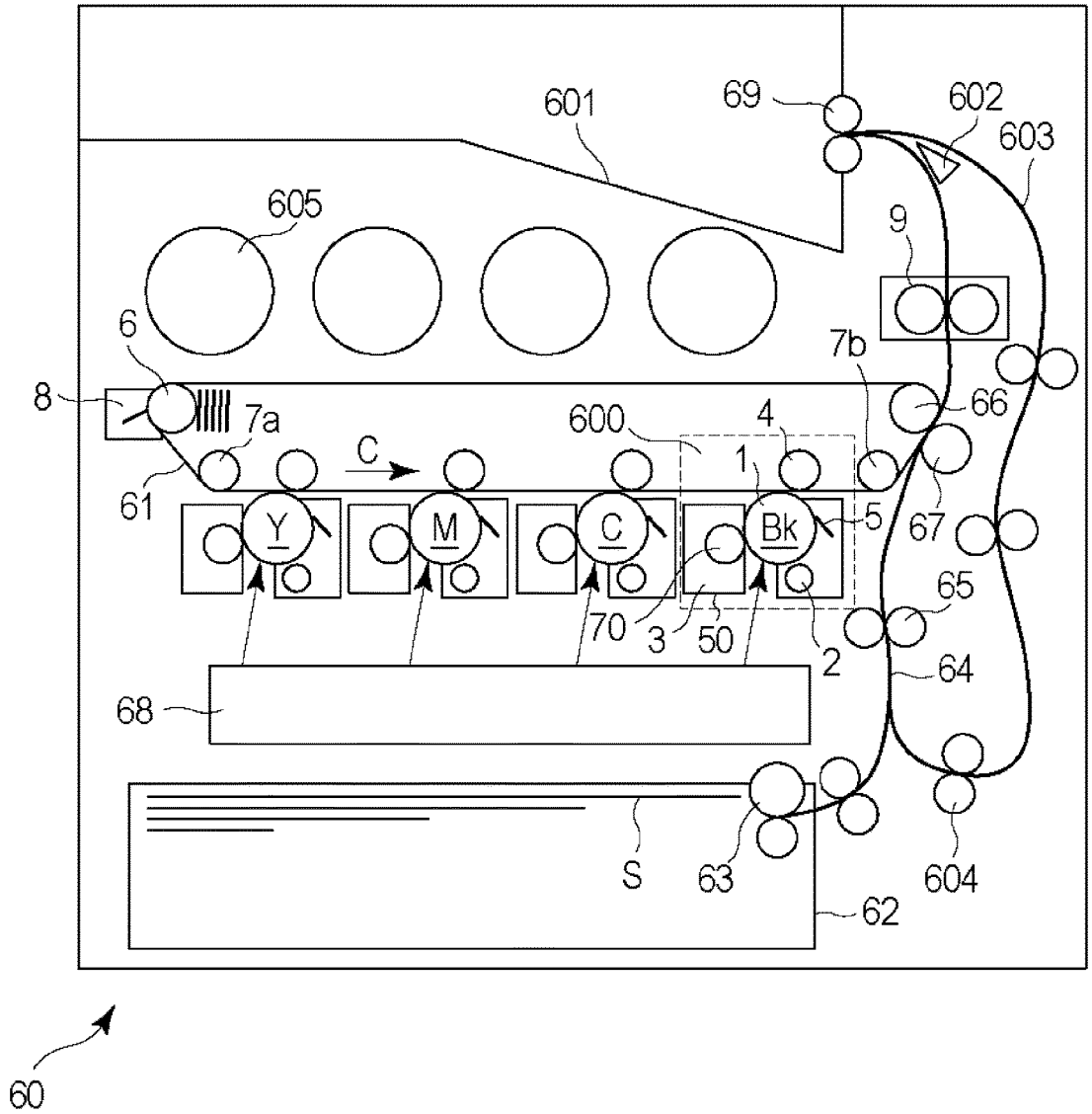
FIG. 1 is a sectional view showing a structure of an image forming apparatus.

First, a structure (constitution) of an image forming apparatus according to the First Embodiment of the present invention will be described with reference to a sectional view of FIG. 1. As shown in FIG. 1, an image forming apparatus 60 includes an endless intermediary transfer belt (ITB) 61 as an intermediary transfer member and four image forming portions 600 provided from an upstream side toward a downstream side along a rotational direction (arrow C direction of FIG. 1) of the intermediary transfer belt 61. The image forming portions 600 form toner images of colors of yellow (Y), magenta (M), cyan (C) and black (Bk), respectively.

The image forming portion 600 includes a rotatable photosensitive drum 1 as an image bearing member. Further, the image forming portion 600 includes a charging roller 2 as a charging means, a developing device 3 as a developing means, a primary transfer roller 4 as a primary transfer means and a photosensitive member cleaner 5 as a photosensitive member cleaning means, which are provided along a rotational direction of the photosensitive drum 1.

Each of the developing devices 3 is detachably mountable to the image forming apparatus 60. Each of the developing devices 3 includes a developing container 50 which accommodates a two-component developer (hereinafter, simply referred to as a developer) containing non-magnetic toner (hereinafter, simply referred to as toner) and a magnetic carrier. Further, each of toner cartridges in which toners of the colors of Y, M, C and Bk is detachably mountable to the image forming apparatus 60. The toners of the respective colors of Y, M, C and Bk pass through toner feeding paths and are supplied to the developing containers 50, respectively. Incidentally, details of each developing device 3 will be described later with reference to FIGS. 2 to 4, and details of each developing container 50 will be described later with reference to FIG. 5.

The intermediary transfer belt 61 is stretched by a tension roller 6, a follower roller 7*a*, the primary transfer roller 4, a follower roller 7*b* and an inner secondary transfer roller 66, and is fed and driven in the arrow C direction of FIG. 1. The inner secondary transfer roller 66 also functions as a driving roller for driving the intermediary transfer belt 61. With rotation of the inner secondary transfer roller 66, the intermediary transfer belt 61 is rotated in the arrow C direction of FIG. 1.

The intermediary transfer belt 61 is pressed from a back-surface side of the intermediary transfer belt 61 by the primary transfer rollers 4. Further, the intermediary transfer belt 61 is contacted to the photosensitive drums 1, so that a primary transfer nip as a primary transfer portion is formed between each of the photosensitive drums 1 and the intermediary transfer belt 61.

At a position opposing the tension roller 6 through the intermediary transfer belt 61, an intermediary transfer member cleaner 8 as a belt cleaning means is contacted to the intermediary transfer belt 61. Further, at a position opposing the inner secondary transfer roller 66 through the intermediary transfer belt 61, an outer secondary transfer roller 67 as a secondary transfer means is provided. The intermediary transfer belt 61 is sandwiched between the inner secondary transfer roller 66 and the outer secondary transfer roller 67. As a result, a secondary transfer nip as a secondary transfer portion is formed between the outer secondary transfer roller 67 and the intermediary transfer belt 61. At the secondary transfer nip, the toner image is attracted to a surface of a sheet S (for example, paper, a film or the like) by applying a predetermined pressing force (pressure) and a transfer bias (electrostatic load bias).

The sheets S are accommodated in a stacked state in a sheet accommodating portion 62 (for example, a feeding cassette, a feeding deck or the like). A feeding means 63 feeds the sheet S in synchronism with image forming timing by using, for example, a friction separation type or the like with a feeding roller or the like. The sheet S fed by the feeding means 63 is fed to a registration roller pair 65 provided at an intermediary position of a feeding path 64. After oblique movement correction and timing correction are carried out by the registration roller pair 65, the sheet S is fed to the secondary transfer nip. In the secondary transfer nip, timing when the sheet S reaches the secondary transfer nip and timing when the toner image reaches the secondary transfer nip coincide with each other, and thus secondary transfer is carried out.

Downstream of the secondary transfer nip with respect to a feeding direction of the sheet S, a fixing device 9 is provided. To the sheet S fed to the fixing device 9, predetermined pressure and predetermined heat quantity are applied from the fixing device 9, so that the toner image is melt-fixed on a surface of the sheet S. The sheet S on which the image is fixed in the above-described manner is discharged onto a discharge tray 601 as it is by normal rotation of a discharging roller pair 69.

In the case where double-side image formation is carried out, after the sheet S is fed by the normal rotation of the discharging roller pair 69 until a trailing end thereof passes through a flapper 602, the discharging roller pair 69 is reversely rotated. As a result, leading and trailing ends of the sheet S are replaced with each other, and the sheet S is fed to a feeding path 603 for the double-side image formation. Thereafter, the sheet S is fed to the feeding path 64 by a re-feeding roller pair 604 in synchronism with subsequent image forming timing.

(Image Forming Process)

During image formation, the photosensitive drum 1 is rotationally driven by a motor. The charging roller 2 charges the surface of the rotationally driven photosensitive drum 1 uniformly in advance. An exposure device 68 forms an electrostatic latent image on the surface of the photosensitive drum 1 charged by the charging roller 2, on the basis of a signal of image information inputted to the image forming apparatus 60. The photosensitive drum 1 is capable of permitting formation of electrostatic latent images of a plurality of sizes.

The developing device 3 includes a rotatable developing sleeve 70 as a developer carrying member for carrying the developer. The developing device 3 develops the electrostatic latent image, formed on the surface of the photosensitive drum 1, with the developer carried on the surface of the developing sleeve 70. As a result, the toner is deposited on an exposed portion on the surface of the photosensitive drum 1, so that the electrostatic latent image is visualized as a visible image (toner image). To the primary transfer roller 4, a transfer bias (electrostatic load bias) is applied, so that the toner image formed on the surface of the photosensitive drum 1 is transferred onto the intermediary transfer belt 61. Toner (transfer residual toner) remaining in a slight amount on the surface of the photosensitive drum 1 after the primary transfer is collected by the photosensitive member cleaner 5, and prepares for a subsequent image forming process.

The image forming processes, for the respective colors, which are performed in parallel by the image forming portions 600 for the respective colors of Y, M, C and Bk are carried out at timings when an associated toner image is successively transferred superposedly onto the toner image for the color on an upstream image forming portion side. As a result, a full-color toner image is formed on the intermediary transfer belt 61, so that the toner image is fed to the secondary transfer nip. To the outer secondary transfer roller 67, a transfer bias is applied, so that the toner image formed on the intermediary transfer belt 61 is transferred onto the sheet S fed to the secondary transfer nip. Toner (transfer residual toner) slightly remaining on the intermediary transfer belt 61 after the sheet S passed through the secondary transfer nip is collected by the intermediary transfer member cleaner 8. The fixing device 9 fixes the toner image transferred on the sheet. The sheet (recording material) S on which the toner image is fixed is discharged onto the discharge tray 601.

A series of image forming processes as described above is ended and then the image forming apparatus 60 prepares for a subsequent image forming operation.

(Structure of Developing Device)

Figure 2:
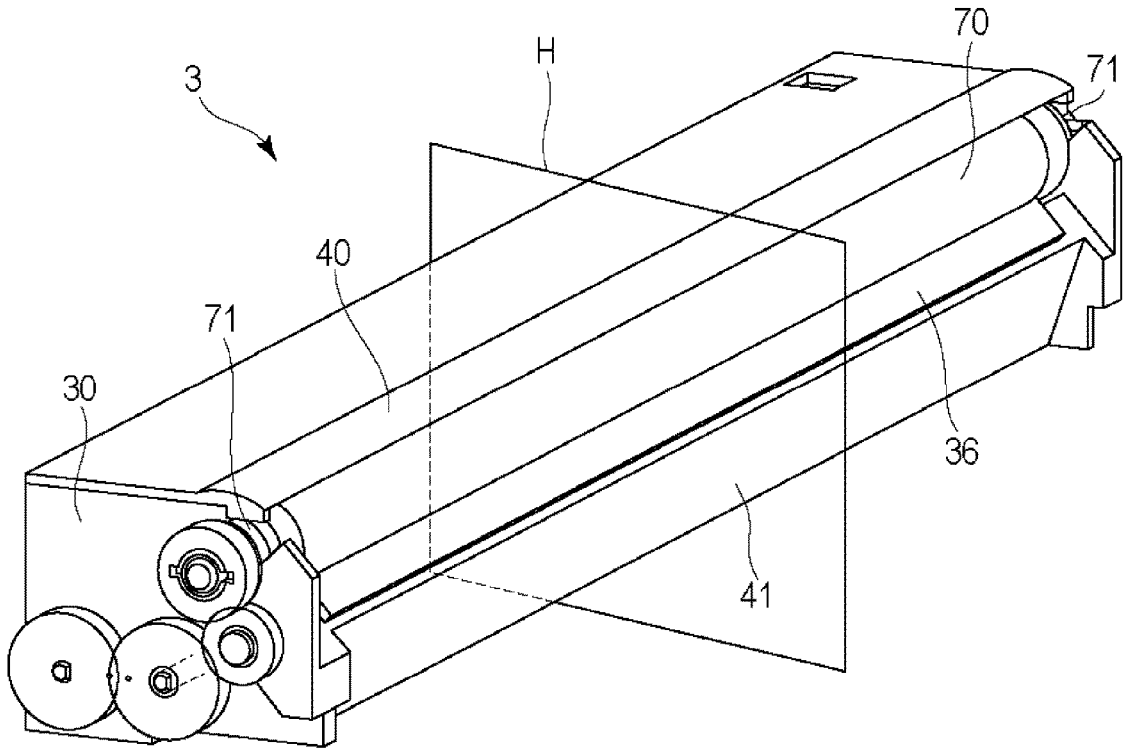
FIG. 2 is a perspective view showing a structure of a developing device.
Figure 3:
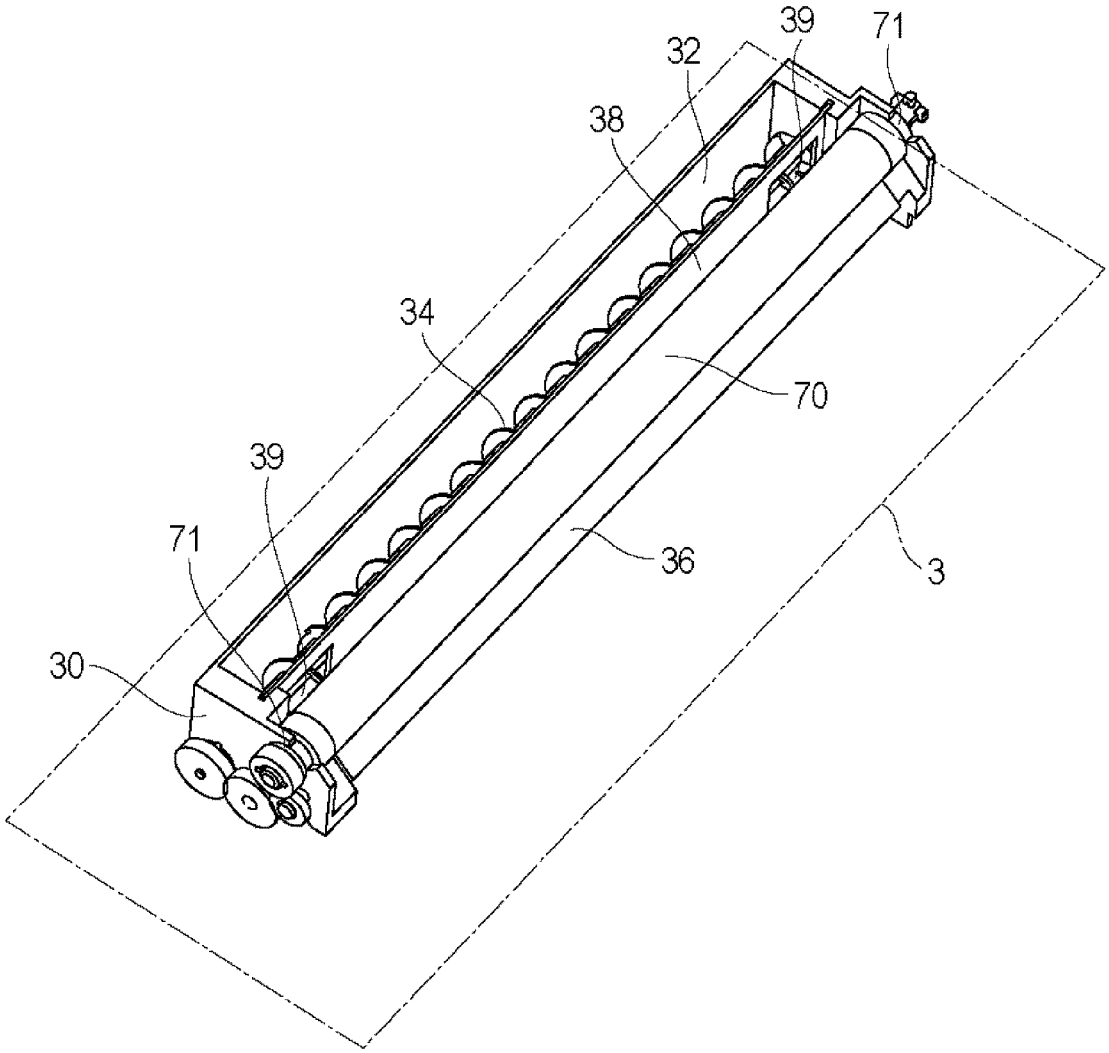
FIG. 3 is a perspective view showing a structure of the developing device.
Figure 4:
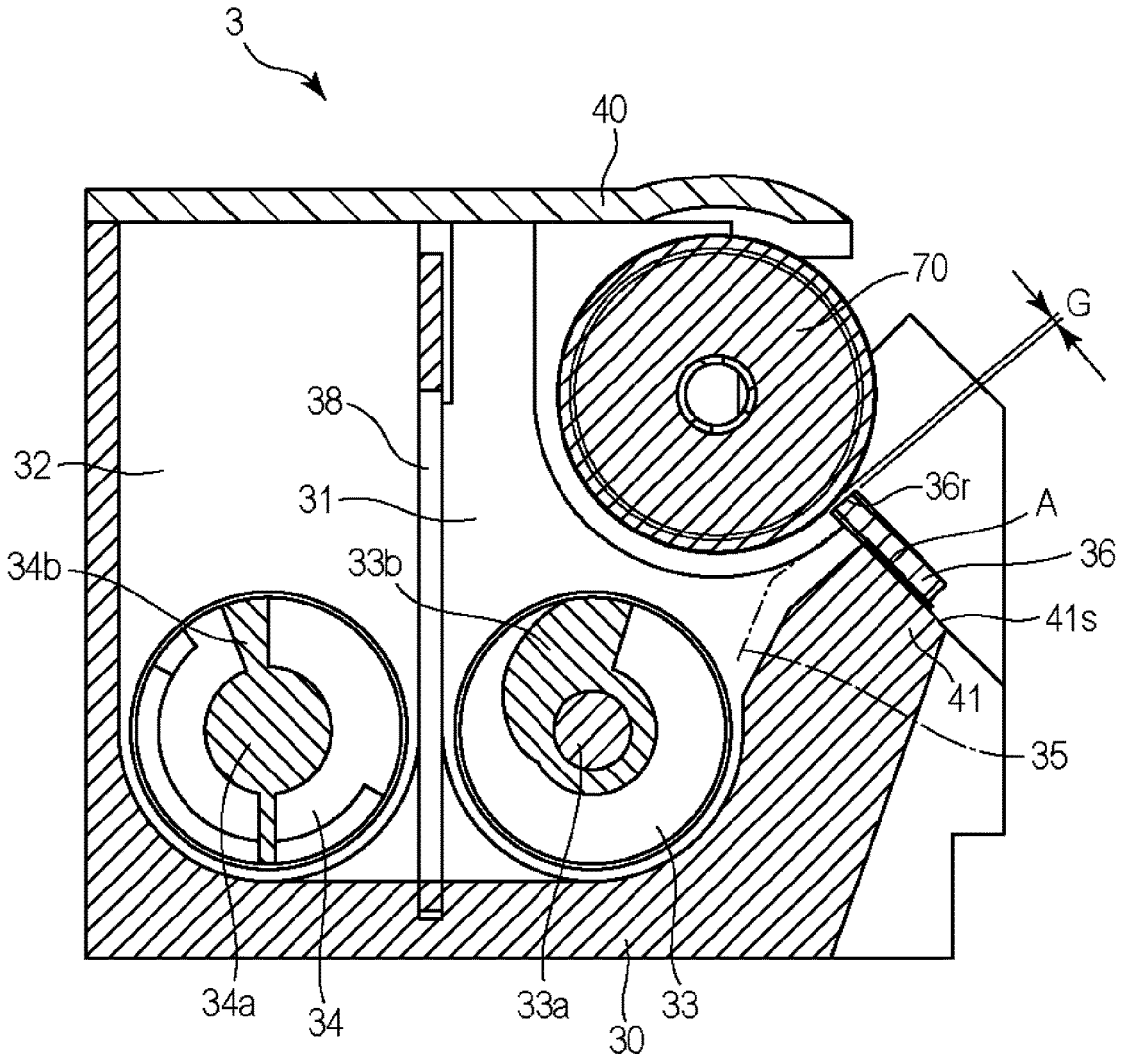
FIG. 4 is a sectional view showing a structure of the developing device.

A general structure of the developing device 3 will be described with reference to perspective views of FIGS. 2 and 3 and a sectional view of FIG. 4, FIG. 4 is the sectional view of the developing device 3 at a cross-section H of FIG. 2.

The developing device 3 includes a resin-made developing device frame 30 molded with a resin material and the developing container 50 which is formed separately from the developing device frame 30 and which is constituted by a resin-made cover frame 40 molded with a resin material. FIG. 2 and FIG. 4 show a state in which the cover frame 40 is mounted on the developing device frame 30, and FIG. 3 shows a state in which the cover frame 40 is not mounted on the developing device frame 30. Incidentally, details of the developing device frame 30 (alone) will be described later with reference to FIG. 6.

The developing container 50 is provided with an opening at a position corresponding to the developing region where the developing sleeve 70 opposes the photosensitive drum 1. At the opening of the developing container 50, the developing sleeve 70 is disposed rotatably relative to the developing container 50 so that a part of the developing sleeve 70 exposes. At each of end portions of the developing sleeve 70, a bearing 71 as a bearing member is provided.

An inside of the developing container 50 is partitioned (sectioned) into a developing chamber 31 as a first chamber and a stirring chamber 32 as a second chamber by a partition wall 38 extending in a vertical direction. The developing chamber 31 and the stirring chamber 32 are connected with each other at longitudinal end portions through two communicating portions 39 provided in the partition wall 38. For that reason, between the developing chamber 31 and the stirring chamber 32, the developer can move through the communicating portions 39. The developing chamber 31 and the stirring chamber 32 are arranged with respect to a horizontal direction.

Inside the developing sleeve 70, a magnet roll, including a plurality of magnetic poles along a rotational direction of the developing sleeve 70, as a magnetic field generating means for generating a magnetic field for carrying the developer on the surface of the developing sleeve 70 is fixedly provided. The developer in the developing chamber 31 is scooped by the influence of the magnetic field of the magnetic pole of the magnetic roll, and is supplied to the developing sleeve 70. Thus, the developer is supplied from the developing chamber 31 to the developing sleeve 70, and therefore, the developing chamber 31 is also referred to as a supplying chamber.

In the developing chamber 31, a first feeding screw 33 as a feeding means for stirring and feeding the developer in the developing chamber 31 is provided opposed to the developing sleeve 70. The first feeding screw 33 includes a rotation shaft 33*a* as a rotatable shaft portion and a helical blade portion 33*b* as a developer feeding portion provided along an outer periphery of the rotation shaft 33*a*, and is supported rotatably relative to the developing container 50. At each of end portions of the rotation shaft 33*a*, a bearing member is provided.

Further, in the stirring chamber 32, a second feeding screw 34 as a feeding means for stirring and feeding the developer in the stirring chamber 32 in a direction opposite to a developer feeding direction of the first feeding screw 33 is provided. The second feeding screw 34 includes a rotation shaft 34*a* as a rotatable shaft portion and a helical blade portion 34*b* as a developer feeding portion provided along an outer periphery of the rotation shaft 34*a*, and is supported rotatably relative to the developing container 50. At each of end portions of the rotation shaft 34*a*, a bearing member is provided. Further, the first feeding screw 33 and the second feeding screw 34 are rotationally driven, whereby a circulating path in which the developer is circulated between the developing chamber 31 and the stirring chamber 32 through the communicating portions 39 is formed.

The developing container 50 is provided with a regulating blade 36 (hereinafter, referred to as a doctor blade) as a developer regulating member for regulating an amount (also referred to as a developer coating amount) of the developer carried on the surface of the developing sleeve 70 so as to oppose the surface of the developing sleeve 70 in contact with the surface of the developing sleeve 70. The doctor blade 36 includes a coating amount regulating surface 36*r* as a regulating portion for regulating an amount of the developer carried on the developing sleeve 70. The doctor blade 36 is a resin-made doctor blade molded with a resin material. Incidentally, a structure of the doctor blade 36 (alone) will be described with reference to FIG. 5.

The doctor blade 36 is disposed opposed to the developing sleeve 70 via a predetermined gap (hereinafter, referred to as an SB gap) G between itself and the developing sleeve 70 over a longitudinal direction of the developing sleeve 70 (i.e., a direction parallel to a rotational axis of the developing sleeve 70). In the present invention, the SB gap G is a minimum distance between a maximum image region of the developing sleeve 70 and a maximum image region of the doctor blade 36. Incidentally, the maximum image region of the developing sleeve 70 refers to a region of the developing sleeve 70 corresponding to a maximum image region of an image region in which the image is formable on the surface of the photosensitive drum 1, with respect to the rotational axis of the developing sleeve 70. Further, the maximum image region of the doctor blade 36 refers to a region of the doctor blade 36 corresponding to the maximum image region of the image region in which the image is formable on the surface of the photosensitive drum 1, with respect to the rotational axis direction of the developing sleeve 70. In the First Embodiment, electrostatic latent images having a plurality of sizes are formable on the photosensitive drum 1, and therefore, the maximum image region refers to an image region corresponding to a largest size (for example, A3 size) of the plurality of sizes in which the electrostatic latent images are formable on the photosensitive drum 1. On the other hand, in a modified example in which the electrostatic latent image having only one size is formable on the photosensitive drum 1, the maximum image region is read as an image region having the only one size in which the electrostatic latent image is formable on the photosensitive drum 1.

The doctor blade 36 is disposed substantially opposed to a peak position of magnetic flux density of the magnetic pole of the magnet roll. The developer supplied to the developing sleeve 70 is influenced by the magnetic field of the magnetic pole of the magnet roll. Further, the developer regulated and scraped off by the doctor blade 36 tends to stagnate at a portion upstream of the SB gap G. As a result, a developer stagnating portion is formed on a side upstream of the doctor blade 36 with respect to the rotational direction of the developing sleeve 70. Then, a part of the developer stagnating at the developer stagnating portion is fed so as to pass through the SB gap with rotation of the developing sleeve 70. At this time, a layer thickness of the developer passing through the SB gap G is regulated by the coating amount regulating surface **36*r* of the doctor blade 36. Thus, a thin layer of the developer is formed on the surface of the developing sleeve 70**.

Then, the developer carried in a predetermined amount on the surface of the developing sleeve 70 is fed to the developing region with the rotation of the developing sleeve 70. Therefore, by adjusting a magnitude of the SB gap G, the amount of the developer fed to the developing region is adjusted. In the First Embodiment, when the magnitude of the SB gap G is adjusted, a target magnitude of the SB gap G (so-called target value of the SB gap G) is set at about 300 μm.

The developer fed to the developing region is magnetically raised in the developing region, so that magnetic chains are formed. By contact of the magnetic chains with the photosensitive drum 1, the toner in the developer is supplied to the photosensitive drum 1. Then, the electrostatic latent image formed on the surface of the photosensitive drum 1 is developed as the toner image. The developer on the surface of the developing sleeve 70 after passing through the developing region and supplying the toner to the photosensitive drum 1 (hereinafter, this developer is referred to as a developer after the developing step) is scraped off of the surface of the developing sleeve by a repelling magnetic field formed between identical-polarity magnetic poles of the magnet roll. The developer, after the developing step, scraped off of the surface of the developing sleeve 70 drops in the developing chamber 31, and thus is collected in the developing chamber 31.

As shown in FIG. 4, in the developing device frame 30, a developer guiding portion 35 for guiding the developer so as to be fed toward the SB gap G is provided. The developer guiding portion 35 and the developing device frame 30 are integrally formed with each other, and the developing guiding portion 35 and the doctor blade 36 are formed separately from each other. The developer guiding portion 35 is formed inside the developing device frame 30 and is disposed on a side upstream of the coating amount regulating surface **36*r* of the doctor blade 36 with respect to the rotational direction of the developing sleeve 70. A flow of the developer is stabilized by the developer guiding portion 35 and thus a density of the developer is adjusted to provide a predetermined developer density, whereby a weight of the developer at a position where the coating amount regulating surface 36*r* of the doctor blade 36 is closest to the surface of the developing sleeve 36** can be determined.

Further, as shown in FIG. 4, the cover frame 40 is formed as a separate member from the developing device frame 30 and is mounted on the developing device frame 30. Further, the cover frame 40 covers a part of an opening of the developing device frame 30 so as to cover a part of an outer peripheral surface of the developing sleeve 70 over an entire region of the developing sleeve 70 with respect to the longitudinal direction of the developing sleeve 70. At this time, cover frame 40 covers a part of the opening of the developing device frame 40 so that the developing region where the developing sleeve 70 opposes the photosensitive drum 1 exposes. The cover frame 40 is fixed to the developing device frame 30 by ultrasonic bonding, but a fixing method of the developing device frame 40 to the cover frame 40 may also be either one of screw fastening, snap fitting, bonding, welding, or the like. Incidentally, as regards the cover frame 40, as shown in FIG. 4, the cover frame 40 may be constituted by a single part (resin mold product) and may also be constituted by a plurality of parts (resin mold products).

(Structure of Resin-Made Doctor Blade)

The structure of the doctor blade (alone) will be described using a perspective view of FIG. 5.

During the image forming operation (developing operation), pressure of the developer generating from a flow of the developer (hereinafter, this pressure is referred to as developer pressure) is exerted on the doctor blade 36. With decreasing rigidity, when the developer pressure is exerted on the doctor blade 36 during the image forming operation, the doctor blade 36 is liable to deform and there is a tendency that the magnitude of the SB gap G is liable to fluctuate. During the image forming operation, the developer pressure is applied in a widthwise direction (an arrow M direction of FIG. 5) of the doctor blade 36. Therefore, in order to suppress a fluctuation in magnitude of the SB gap during the image forming operation, it is desirable that the doctor blade 36 is made strong against deformation with respect to the widthwise direction thereof by increasing the rigidity of the doctor blade 36 with respect to the widthwise direction.

Figure 5:
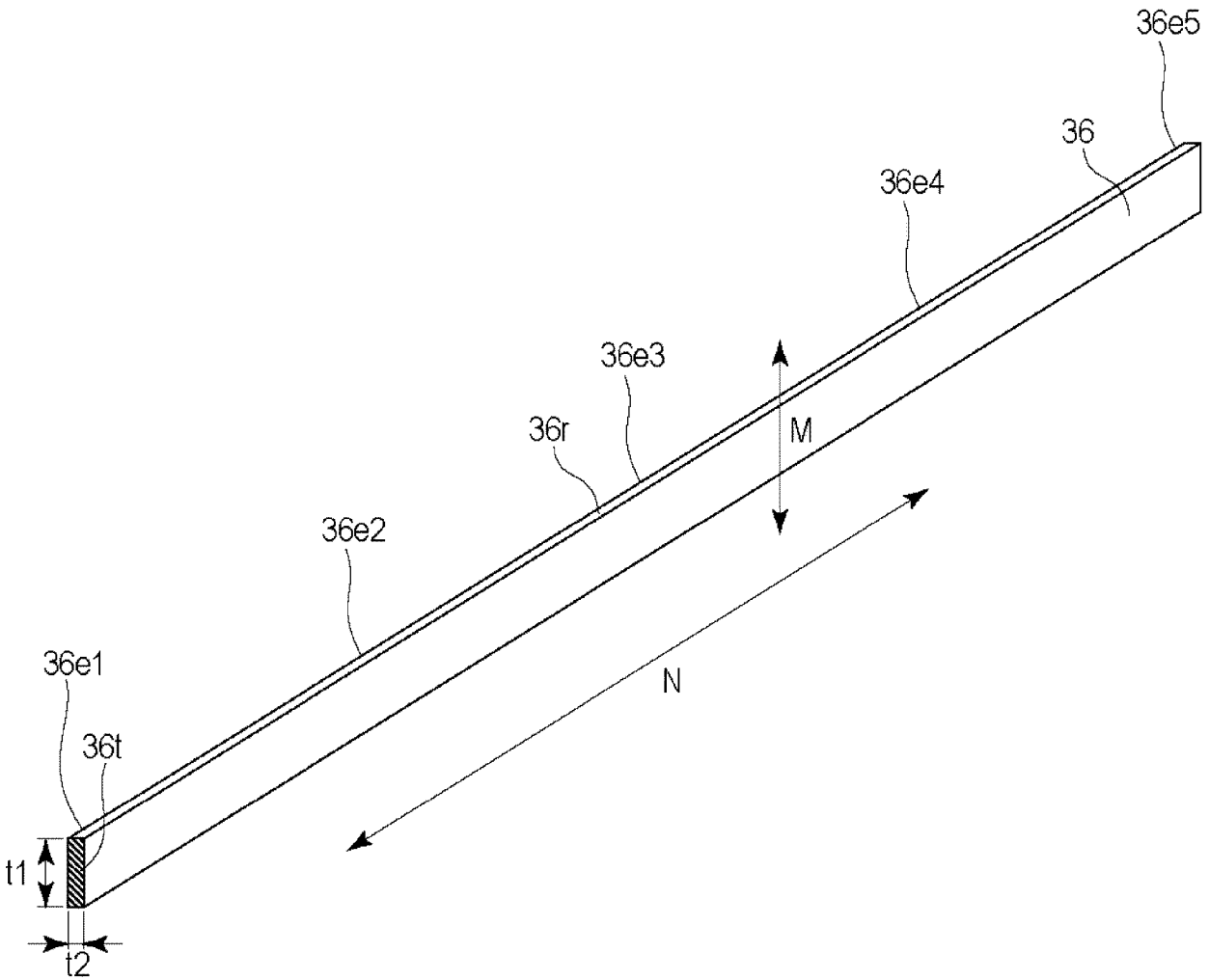
FIG. 5 is a perspective view showing a structure of a resin-made doctor blade (alone).

As shown in FIG. 5, a shape of the doctor blade 36 is a plate shape from viewpoints of mass production and cost. Further, as shown in FIG. 5, a cross-sectional area of a side surface **36*t* of the doctor blade 36 is made small, and a length $t_2$ of the doctor blade 36 with respect to a thickness direction is made smaller than a length $t_1$ of the doctor blade 36 with respect to a widthwise direction of the doctor blade 36. As a result, the doctor blade 36 (alone) has a constitution in which the doctor blade 36 is liable to deform in a direction (an arrow M direction of FIG. 5) perpendicular to the longitudinal direction (an arrow N direction of FIG. 5) of the doctor blade 36. Therefore, in order to correct straightness of the coating amount regulating surface 36*r*, in a state in which at least a part of the doctor blade 36 is flexed in the arrow M direction of FIG. 5, the doctor blade 36 is fixed to a blade mounting portion 41** of the developing device frame 30. Incidentally, details of correction of the straightness will be described later with reference to FIG. 9.

(Structure of Resin-Made Developing Device Frame)

Figure 6:
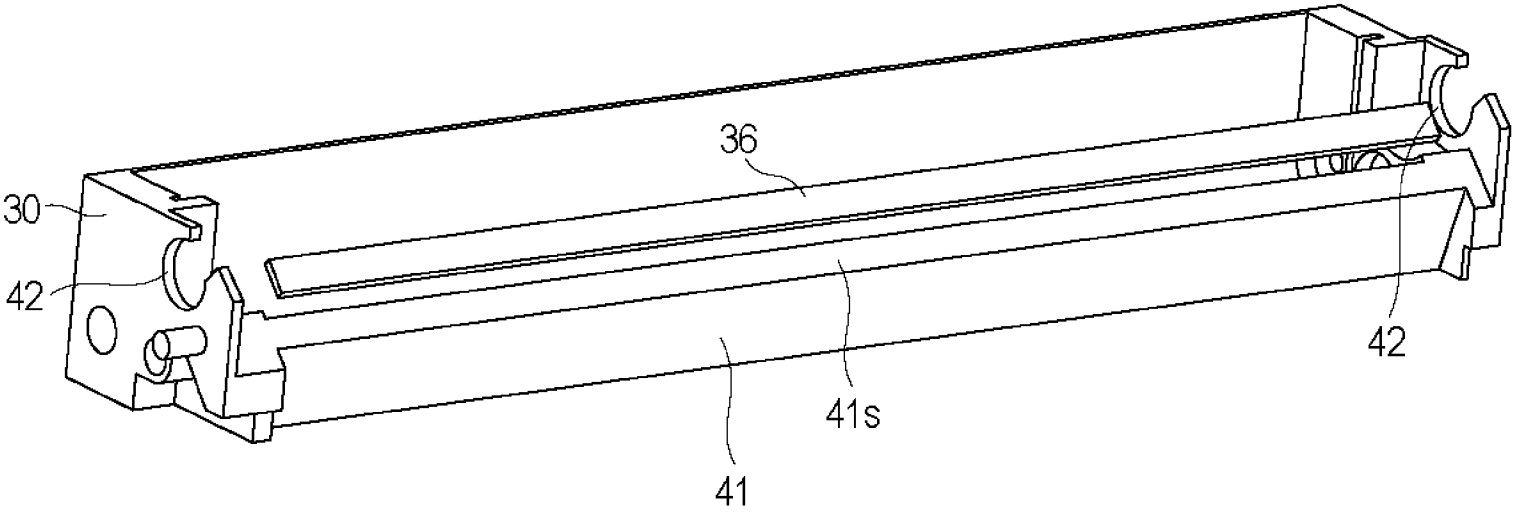
FIG. 6 is a perspective view showing a structure of a resin-made developing device frame (alone).

The structure of the developing device frame 30 (alone) will be described using a perspective view of FIG. 6. FIG. 6 shows a state in which the cover frame 40 is not mounted on the developing device frame 30.

The developing device frame 30 includes the developing chamber 31 and the stirring chamber 32 which is partitioned from the developing chamber 31 by the partition wall 38. The partition wall 38 is molded with a resin material, and may also be formed separately from the developing device frame 30 and may also be formed integrally with the developing device frame 30.

The developing device frame 30 includes a sleeve supporting portion 42 for rotatably supporting the developing sleeve 70 by supporting the bearings 71 provided at the longitudinal end portions of the developing sleeve 70. The developing device frame 30 further includes the blade mounting portion 41, formed integrally with the sleeve supporting portion 42, for mounting the doctor blade 36. FIG. 6 shows a phantom state in which the doctor blade 36 is caused to float from the blade mounting portion 41.

In a state in which the doctor blade 36 is mounted on the blade mounting portion 41, an adhesive A applied onto a blade mounting surface 41*s* of the blade mounting portion 41 is cured, so that the doctor blade 36 is fixed on the blade mounting portion 41.

(Rigidity of Resin-Made Doctor Blade)

The rigidity of the doctor blade 36 (alone) will be described using a schematic view of FIG. 7. The rigidity of the doctor blade 36 is measured in a state in which the doctor blade 36 is not fixed on the blade mounting portion 41 of the developing device frame 30.

Figure 7:
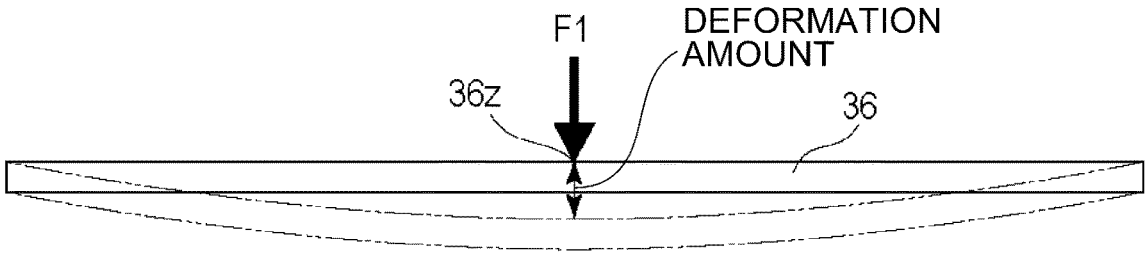
FIG. 7 is a schematic view for illustrating rigidity of the resin-made doctor blade (alone).

As shown in FIG. 7, a concentrated load F1 is exerted in the widthwise direction of the doctor blade 36 on a central portion 36*z* of the doctor blade 36 with respect to the longitudinal direction of the doctor blade 36. At this time, the rigidity of the doctor blade 36 (alone) is measured on the basis of an amount of flexure of the doctor blade 36 in the widthwise direction at the central portion 36*z* of the doctor blade 36.

For example, it is assumed that the concentrated load F1 of 300 gf is exerted in the widthwise direction of the doctor blade 36 on the central portion 36*z* of the doctor blade 36 with respect to the longitudinal direction of the doctor blade 36. At this time, at the central portion 36*z* of the doctor blade 36, the amount of flexure of the doctor blade 36 in the widthwise direction is 700 μm or more. Incidentally, at this time, an amount of deformation in cross-section of the doctor blade 36 at the central portion 36*z* is 5 μm or less.

(Rigidity of Resin-Made Developing Device Frame)

The rigidity of the developing device frame 30 (alone) will be described using a schematic view of FIG. 8. The rigidity of the developing device frame 30 is measured in a state in which the doctor blade 36 is not fixed on the blade mounting portion 41 of the developing device frame 30.

Figure 8:
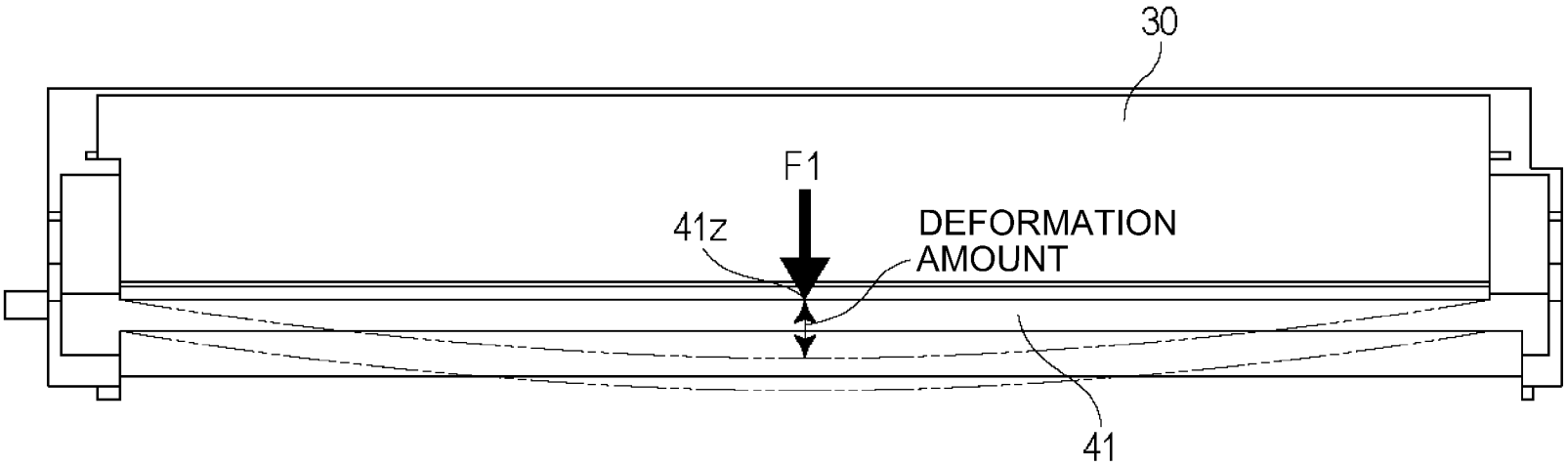
FIG. 8 is a schematic view for illustrating rigidity of the resin-made developing device frame (alone).

As shown in FIG. 8, a concentrated load F1 is exerted in the widthwise direction of the blade mounting portion 41 on a central portion 41*z* of the blade mounting portion 41 with respect to the longitudinal direction of the blade mounting portion 41. At this time, the rigidity of the developing device frame 30 (alone) is measured on the basis of an amount of flexure of the blade mounting portion 41 in the widthwise direction at the central portion 41*z* of the blade mounting portion 41.

For example, it is assumed that the concentrated load F1 of 300 gf is exerted in the widthwise direction of the blade mounting portion 41 on the central portion 41*z* of the blade mounting portion 41 with respect to the longitudinal direction of the blade mounting portion 41. At this time, at the central portion 41*z* of the blade mounting portion 41, the amount of flexure of the blade mounting portion 41 in the widthwise direction is 60 μm or less.

It is assumed that the same concentrated load F1 in magnitude is exerted on each of the central portion 36*z* of the doctor blade 36 and the central portion 41*z* of the blade mounting portion 41. At this time, the amount of flexure of the doctor blade 36 at the central portion 36*z* is not less than 10 times higher than the amount of flexure of the blade mounting portion 41 at the central portion 41*z*. Therefore, the rigidity of the developing device frame 30 (alone) is not less than 10 times higher than the rigidity of the doctor blade 36 (alone). For that reason, in a state in which the doctor blade 36 is mounted on the blade mounting portion 41 of the developing device frame 30 and is fixed on the blade mounting portion 41 of the developing device frame 30, compared with the rigidity of the doctor blade 36, the rigidity of the developing device frame 30 is predominant. Further, in the case where the doctor blade 36 is fixed on the developing device frame 30 over an entire area of the maximum image region, compared with the case where the doctor blade 36 is fixed on the developing device frame 30 only at the longitudinal end portions, the rigidity of the doctor blade 36 in a state in which the doctor blade 36 is fixed on the developing device frame 30 becomes high.

Further, the rigidity of the developing device frame 30 (alone) is larger than the rigidity of the cover frame 40 (alone). For that reason, in a state in which the cover frame 40 is mounted on the developing device frame 30 and is fixed to the developing device frame 30, compared with the rigidity of the cover frame 40, the rigidity of the developing device frame 30 is predominant.

(Correction of Straightness of Resin-Made Doctor Blade)

Correspondingly to an increase in width of the sheet S such as the case where the width of the sheet S on which the image is to be formed is an A3 size, with respect to a direction parallel to the rotational axis of the developing sleeve 70, a length of the maximum image region of the image region in which the image is formable on the surface of the photosensitive drum 1 becomes large. For that reason, the length of the maximum image region of the doctor blade 36 becomes large correspondingly to the increase in width of the sheet S on which the image is to be formed. In the case where the doctor blade large in longitudinal length is molded with a resin material, it is difficult to ensure the straightness of the coating amount regulating surface of the doctor blade made of resin material. This is because in the case where the doctor blade large in longitudinal length is molded with the resin material, when the thermally expanded resin material thermally contracts, depending on the longitudinal position of the doctor blade, portions where the thickness advances and delays are liable to generate.

For that reason, as regards the resin-made doctor blade, there is a tendency that with an increasing length of the doctor blade with respect to the longitudinal direction, due to the straightness of the coating amount regulating surface of the doctor blade, the SB gap is liable to become different with respect to the longitudinal direction of the developer carrying member. When the SB gap is different with respect to the longitudinal direction of the developer carrying member, there is a liability that with respect to the longitudinal direction of the developer carrying member, non-uniformity of the amount of the developer carried on the surface of the developer carrying member occurs.

For example, in the case where the resin-made doctor blade having a length corresponding to a longitudinal length of an A3-size sheet (hereinafter, this doctor blade is referred to as an A3-size compatible resin-made doctor blade) is manufactured with accuracy of a general purpose resin mold product, the straightness of the coating amount regulating surface is about 300 μm-500 μm. Further, even if the A3-size compatible resin-made doctor blade is manufactured with high accuracy by using a high-accuracy resin material, the straightness of the coating amount regulating surface is about 100 μm-200 μm.

In this embodiment, the magnitude of the SB gap G is set at about 300μ, and a tolerance of the SB gap G (i.e., a tolerance with respect to the target value of the SB gap G) is set at within ±10%. Therefore, in this embodiment, this means that an adjusting range of the SB gap G is 300 μm±30 μm and that an allowable tolerance of the SB gap G is 60 μm to the maximum. For this reason, even when the A3-size compatible resin-made doctor blade is manufactured with the accuracy of the general purpose resin mold product or is manufactured with high accuracy by using a high-accuracy resin material, only by the accuracy of the straightness of the coating amount regulating surface, a resultant value exceeds an allowable range as the tolerance of the SB gap G.

In the developing device including the resin-made doctor blade, irrespective of the straightness of the coating amount regulating surface, in the state in which the doctor blade is fixed to the mounting portion of the developing device frame, it is desired that the SB gap G falls within a predetermined range over the direction parallel to the rotational axis of the developer carrying member. Therefore, in this embodiment, even when the resin-made doctor blade low in straightness of the coating amount regulating surface, by correcting the straightness of the coating amount regulating surface, in the state in which the doctor blade is fixed to the mounting portion of the developing device frame, the SB gap G is caused to fall within the predetermined range over the direction parallel to the rotational axis of the developing sleeve 70.

Here, the straightness of the coating amount regulating surface 36*r* of the doctor blade 36 will be described using a schematic view of FIG. 9. The straightness of the coating amount regulating surface 36*r* of the doctor blade 36 is represented by an absolute value of a difference between a maximum and a minimum of an outer configuration of the coating amount regulating surface 36*r* when a predetermined amount P of the coating amount regulating surface 36*r* with respect to the longitudinal direction of the coating amount regulating surface 36*r* is used as a reference position. For example, when a central portion of the coating amount regulating surface 36*r* with respect to the longitudinal direction of the coating amount regulating surface 36*r* is used as an origin of a rectangular (orthogonal) coordinate system, a predetermined rectilinear line passing through the origin is X-axis and a rectilinear line drawn from the origin perpendicularly to the X-axis is Y-axis. In this rectangular coordinate system, the straightness of the coating amount regulating surface 36*r* is represented by an absolute value of a difference between a maximum and a minimum of a Y-coordinate of the outer configuration of the coating amount regulating surface 36*r*.

Figure 9:
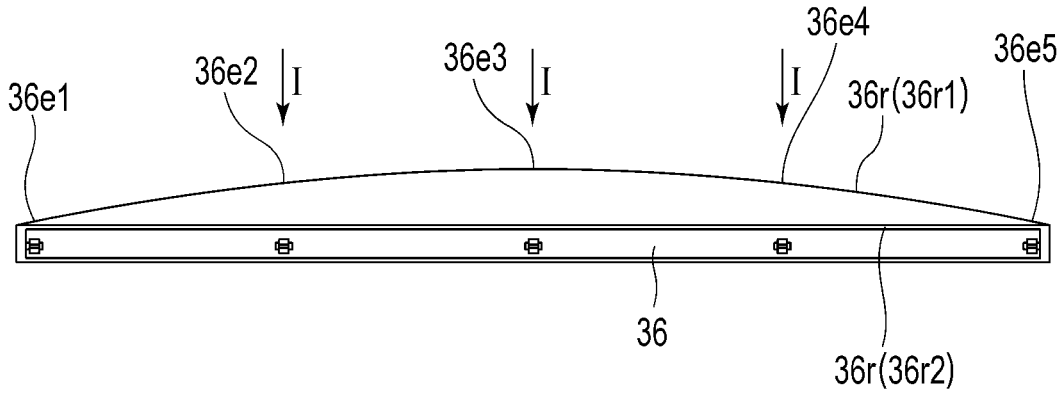
FIG. 9 is a schematic view for illustrating straightness of the resin-made doctor blade (alone).

As shown in FIG. 9, the resin-made doctor blade (alone) has a shape such that with respect to the longitudinal direction of the doctor blade 36, the coating amount regulating surface 36*r* of the doctor blade 36 largely flexes at the central portion. For that reason, there is a need to correct the straightness of the doctor blade 36 by decreasing a difference among positions of free end portions 36*e* (36*e*1 to 36*e*5). In view of an allowable value of the tolerance of the SB gap G, mounting accuracy of the doctor blade 36 on the developing device frame 30, and the like, the straightness of the coating amount regulating surface 36*r* of the doctor blade 36 is required to be corrected to 50 μm or less. Incidentally, in view of not more than 20 μm of the accuracy of the straightness of a metal-made doctor blade prepared by secondary cutting work of metal, the straightness of the coating amount regulating surface 36*r* of the doctor blade 36 may preferably be corrected to 20 μm or less. In view of a practical mass-production step, a setting value of correction of the straightness of the coating amount regulating surface 36*r* of the doctor blade 36 is about 20 μm-50 μm.

Therefore, a force for causing the doctor blade 36 to flex in at least a part of the maximum image region (hereinafter, this force is referred to as a straightness correcting force) is applied to the doctor blade 36, so that the doctor blade 36 is caused to flex in at least the part of the maximum image region. As a result, the straightness of the coating amount regulating surface 36*r* of the doctor blade 36 is corrected to not more than 50 μm.

In an example of FIG. 9, outer configurations of the free end portions 36*e*1 and 36*e*5 of the doctor blade 36 are used as references, and the straightness correcting force is applied on the basis of the references in arrow I directions to the free end portions 36*e*2, 36*e*3 and 36*e*4 so that outer configurations of the free end portions 36*e*2, 36*e*3 and 36*e*4 coincide with those of the free end portions 36*e*1 and 36*e*5. As a result, the shape of the coating amount regulating surface 36*r* of the doctor blade 36 is corrected from a coating amount regulating surface 36*r*1 to a coating amount regulating surface 36*r*2, so that the straightness of the coating amount regulating surface 36*r* of the doctor blade can be corrected to not more than 50 μm. Incidentally, in the example of FIG. 9, the references when the outer configurations of the free end portions 36*r* of the doctor blade 36 are made the same were the outer configurations of the free end portions 36*e*1 and 36*e*5 (longitudinal end portions of the coating amount regulating surface 36*r*), but may also be the outer configuration of the free end portion 36*e*3 (longitudinal central portion of the coating amount regulating surface 36*r*). In that case, the outer configuration of the free end portion 36*e*3 of the doctor blade 36 is used as a reference, and the straightness correcting force is applied to the doctor blade 36 so that outer configurations of the free end portions 36*e*1, 36*e*2, 36*e*4 and 36*e*5 coincide with the outer configuration of the free end portion 36*e*3.

Thus, in order to make the straightness correction of the doctor blade 36, there is a need to lower the rigidity of the doctor blade (alone) so that the doctor blade 36 is flexed in at least the part of the maximum image region of the coating amount regulating surface 36*r* when the straightness correcting force is applied to the doctor blade 36.

(SB Gap Adjusting Method)

Adjustment of the SB gap G is carried out by moving the position of the doctor blade 36 relative to the developing device frame 30 so that a relative position of the doctor blade 36 mounted on the blade mounting portion 41 is adjusted with respect to the developing sleeve 70 supported by the sleeve supporting portion 42. At a predetermined position of the blade mounting portion 41 determined by adjusting the SB gap G, the doctor blade 36 flexed in at least the part of the maximum image region of the doctor blade 36 is fixed with the adhesive A applied over the entire area of the maximum image region of the blade mounting surface 41*s* in advance. Incidentally, the maximum image region of the blade mounting surface 41*s* refers to a region of the blade mounting surface 41*s* corresponding to a maximum image region of the image region in which the image is formable on the surface of the photosensitive drum 1. At this time, of the maximum image region of the doctor blade 36, as regards a region in which the doctor blade 36 is flexed for correcting the straightness of the coating amount regulating surface 36*r*, the doctor blade 36 is fixed to the blade mounting portion 41. Incidentally, when the doctor blade 36 is fixed to the blade mounting portion 41 with the adhesive A in a region where a force for flexing the doctor blade 36 in at least the part of the maximum image region is applied, the adhesive A is not required to be applied onto a part of the blade mounting surface 41*s*. Therefore, that the adhesive A is applied over the entire area of the maximum image region of the blade mounting surface 41*s* satisfies the following condition. The adhesive A is applied in a region which includes the region, of the region corresponding to the maximum image region of the doctor blade 36, in which the doctor blade 36 is flexed for correcting the straightness of the coating amount regulating surface 36*r* and which is sot set less than 95% of the maximum image region of the blade mounting surface 41*s*.

As a result, of the maximum image region of the doctor blade 36, in the region in which the doctor blade 36 is flexed for correcting the straightness of the coating amount regulating surface 36*r*, it is possible to suppress a phenomenon that the state of the doctor blade 36 is likely to be returned from a flexed state to an original state before the flexure. By doing so, the doctor blade 36 is fixed to the blade mounting portion 41 in a state in which the straightness of the coating amount regulating surface 36*r* is corrected to not more than 50 μm.

Incidentally, the magnitude of the SB gap G is measured (calculated) by a method described below. Incidentally, measurement of the magnitude of the SB gap G is carried out in a state in which the developing sleeve 70 is supported by the sleeve supporting portion 42 of the developing device frame 30 and the doctor blade 36 is mounted on the blade mounting portion 41 and in which the cover frame 40 is fixed to the developing device frame 30.

When the magnitude of the SG gap G is measured, a light source (for example, an LED array, a light guide or the like) is inserted into the developing chamber 31 over the longitudinal direction of the developing chamber 31. The light source inserted in the developing chamber 31 emits light toward the SB gap G forming an inside of the developing chamber 31. Further, at each of five places corresponding to the free end portions 36*e* (36*e*1 to 36*e*5) of the doctor blade 36, a camera for picking up a light beam emitted to an outside of the developing device frame 30 through the SB gap G is provided.

The cameras disposed at the five places pick up light beams emitted to the outside of the developing device frame 30 through the SB gap G in order to measure the respective positions of the free end portions 36*e* (36*e*1 to 36*e*5) of the doctor blade 36. At that time, the cameras read a closest position of the developing sleeve 70 with the doctor blade 36 on the surface of the developing sleeve 70 and read the free end portions 36*e* (36*e*1 to 36*e*5) of the doctor blade 36. Then, pixel values are converted from image data generated by being read with the cameras into distances, so that the magnitude of the SB gap G is calculated. In the case where the calculated magnitude of the SB gap G does not fall within a predetermined range, adjustment of the SB gap G is carried out. Then, when the calculated magnitude of the SB gap G falls within the predetermined range, the position is determined as a position where the doctor blade 36 flexed in at least the part of the maximum image region of the doctor blade 36 is fixed to the blade mounting portion 41 of the developing device frame 30.

Incidentally, by a method described later, whether or not the SB gap G falls within the predetermined range over a direction parallel to the rotational axis of the developing sleeve 70 is discriminated. First, the maximum image region of the doctor blade 36 is equidistantly divided into four or more regions, and in each of the divided regions (but including both end portions and a central portion of the maximum image region of the doctor blade 36), the SB gap G is measured at five places or more. Then, from samples of measured values of the SB gap G measured at five places or more, a maximum value, a minimum value and a median value of the SB gap G are extracted.

At this time, an absolute value of a difference between the maximum value and the median value of the SB gap G may only be required to be not more than 10% of the median value of the SB gap G, and an absolute value of a difference between the minimum value and the median value of the SB gap G may only be required to be not more than 10% of the median value of the SB gap G. In this case, on assumption that the tolerance of the SB gap G is ±10% or less, the SB gap G satisfies that the SB gap G falls within the predetermined range over the direction parallel to the rotational axis of the developing sleeve 70. For example, in the case where from the samples of the measured values of the SB gap G measured at five places or more, the median value of the SB gap G was 300 μm, it may only be required that the maximum value of the SB gap G is 330 μm or less and the minimum value of the SB gap G is 270 μm or more. That is, in this case, an adjusting range of the SB gap G is 300 μm±30 μm, so that as the tolerance of the SB gap G (i.e., the tolerance of the SB gap G to the target value), up to 60 μm at the maximum is permitted.

(Linear Expansion Coefficient)

Then, deformation of the doctor blade 36 and the developing device frame 30 due to a change in temperature by heat generated during the image forming operation will be described using a perspective view of FIG. 10. As heat generating during the image forming operation, for example, there is heat generating during rotation of the rotation shaft of the developing sleeve 70 and the bearing 71, heat generating during rotation of the rotation shaft 33*a* of the first feeding screw 33 and the bearing member thereof, and heat generating when the developer passes through the SB gap G, and the like. By the heat generated during the image forming operation, an ambient temperature of the developing device 3 changes, so that temperatures of the doctor blade 36, the developing device frame 30 and the cover frame 40 also change.

Figure 10:
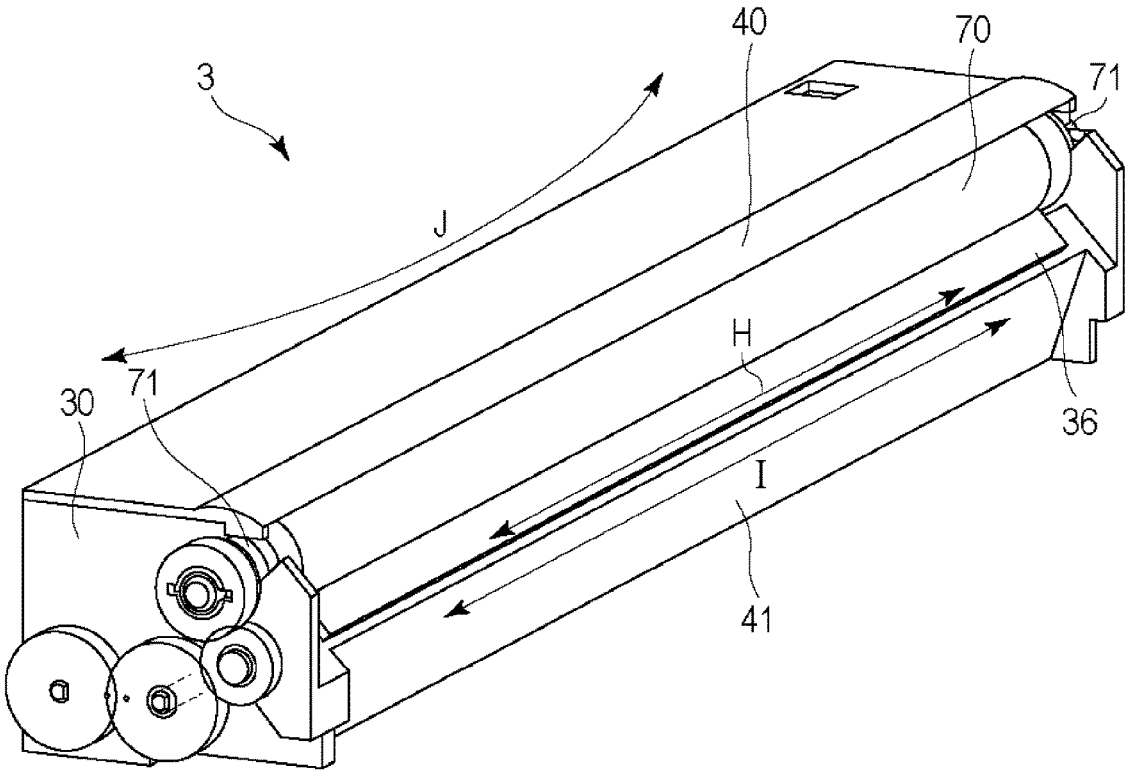
FIG. 10 is a perspective view for illustrating deformation of the resin-made doctor blade due to a temperature change.

As shown in FIG. 10, an elongation amount of the doctor blade 36 due to the temperature change is H (μm), and an elongation amount of the blade mounting surface 41*s* of the blade mounting portion 41 of the developing device frame 30 is I (μm). Further, a linear expansion coefficient $\alpha 1$ of the resin material constituting the doctor blade 36 and a linear expansion coefficient $\alpha 2$ of the resin material contacting the developing device frame 30 are different from each other. In this case, due to a difference between these linear expansion coefficients, deformation amounts of the developing device frame 30 and the doctor blade 36 by the temperature changes are different from each other, so that in order to eliminate a difference between H (μm) and I (μm), the doctor blade 36 deforms in an arrow J direction of FIG. 10. The deformation of the doctor blade 36 in the arrow J direction of FIG. 10 is referred to as deformation of the doctor blade 36 in a warping direction. Further, the deformation of the doctor blade 36 in the warping direction leads to a fluctuation in magnitude of the SB gap G. In order to suppress the fluctuation in magnitude of the SB gap G resulting from the heat, the linear expansion coefficient $\alpha 2$ of the resin material constituting the sleeve supporting portion 42 and the blade mounting portion 41 of the developing device frame 30 (alone) and the linear expansion coefficient $\alpha 1$ of the resin material constituting the doctor blade 36 (alone) are associated with each other. That is, in the case where the linear expansion coefficient $\alpha 1$ of the resin material constituting the doctor blade 36 and the linear expansion coefficient $\alpha 2$ of the resin material constituting the developing device frame 30 are different from each other, due to the difference between these linear expansion coefficients, an amount of a change resulting from the temperature change varies.

In general, the resin material is larger in linear expansion coefficient than the metal material. In the case where the doctor blade 36 is made of the resin material, with the temperature change by the heat generating during the image forming operation, the warping deformation of the doctor blade 36 occurs, so that the doctor blade 36 is liable to flex at the longitudinal central portion. As a result, in the photosensitive drum in which the resin-made doctor blade 36 is fixed to the resin-made developing device frame, the magnitude of the SB gap G is liable to fluctuate with the temperature change during the image forming operation.

In order to correct the straightness of the coating amount regulating surface 36*r* to not more than 50 μm, the doctor blade 36 is flexed in at least the part of the maximum image region thereof. Further, a method in which the doctor blade 36 flexed in at least the part of the maximum image region is fixed to the blade mounting portion 41 of the developing device frame 30 with the adhesive A over the entire area of the maximum image region of the doctor blade 36 is employed.

At this time, in the case where there is a large difference between the linear expansion coefficient $\alpha 2$ of the resin material constituting the developing device frame 30 and the linear expansion coefficient $\alpha 1$ of the resin material constituting the doctor blade 36, when the temperature change occurs, the following problem arises. That is, when the temperature change occurs, a deformation amount (expansion/contraction amount) of the doctor blade 36 due to the temperature change and a deformation amount (expansion/contraction amount) of the developing device frame 30 due to the temperature change are different from each other. As a result, even in the case where the SB gap G is adjusted with high accuracy when the position where the doctor blade 36 is mounted on the blade mounting surface 41*s* of the developing device frame 30 is determined, the magnitude of the SB gap G is fluctuated due to the temperature change during the image forming operation.

The doctor blade 36 is fixed to the blade mounting surface 41*s* over the entire area of the maximum image region, and therefore, there is a need to suppress the fluctuation in magnitude of the SB gap G resulting from the temperature change during the image forming operation. As regards the fluctuation amount of the SB gap G due to the heat, with respect to the longitudinal direction of the developing sleeve 70, in order to suppress non-uniformity of the amount of the developer carried on the surface of the developing sleeve 70, there is a need to suppress the fluctuation amount to not more than ±20 μm in general.

A difference of the linear expansion coefficient $\alpha 2$ of the resin material constituting the developing device frame 30 including the sleeve supporting portion 42 and the blade mounting portion 41 from the linear expansion coefficient $\alpha 1$ of the resin material constituting the doctor blade 36 is hereinafter referred to as a linear expansion coefficient difference ($\alpha 2-\alpha 1$). A change in maximum flexure amount of the doctor blade 36 due to this linear expansion coefficient difference ($\alpha 2-\alpha 1$) will be described using Table 1. In a state in which the doctor blade 36 was fixed to the blade mounting portion 41 of the developing device frame 30 over the entire area of the maximum image region of the doctor blade 36, measurement of the maximum flexure amount of the doctor blade when the temperature change from a normal temperature (23° C.) to a high temperature (40° C.) was made was carried out.

The linear expansion coefficient of the resin material constituting the developing device frame 30 including the sleeve supporting portion 42 and the blade mounting portion 41 is $\alpha 2$ (m/° C.), and the linear expansion coefficient of the resin material constituting the doctor blade 36 is $\alpha 1$ (m/° C.). Then, the linear expansion coefficient difference ($\alpha 2-\alpha 1$) was changed, and the maximum flexure amount of the doctor blade 36 was measured. A result thereof is shown in Table 1. In Table 1, in the case where the absolute value of the maximum flexure amount is not more than 20 μm, the maximum flexure amount is evaluated as "o", and in the case where the absolute value of the maximum flexure amount is larger than 20 μm, the maximum flexure amount is evaluated as "x".

TABLE 1

| $\alpha 2-\alpha 1$ [$\times 10^{-5}$ m/° C.] | MFA*1 |
|---|---|
| 0 | ○ |
| +0.20 | ○ |
| +0.40 | ○ |
| +0.50 | ○ |
| +0.54 | ○ |
| +0.55 | ○ |
| +0.56 | x |
| +0.57 | x |
| +0.60 | x |
| 0 | ○ |
| −0.20 | ○ |
| −0.40 | ○ |
| −0.44 | ○ |
| −0.45 | ○ |
| −0.46 | x |
| −0.47 | x |
| −0.50 | x |

*1"MFA" is the maximum flexure amount of the doctor blade.

As is understood from Table 1, in order to suppress the fluctuation amount of the SB gap G due to the heat to not more than ±20 μm, there is a need that the linear expansion coefficient difference ($\alpha 2-\alpha 1$) satisfies the following relationship (1):

$$-0.45\times 10^{-5}\ (\text{m/° C.}) \leq \alpha 2-\alpha 1 \leq 0.55\times 10^{-5}\ (\text{m/° C.}) \quad (1).$$

Therefore, the resin material constituting the developing device frame 30 and the resin material constituting the doctor blade 36 may only be required to be selected so that the linear expansion coefficient difference ($\alpha 2-\alpha 1$) is $-0.45\times 10^{-5}$ (m/° C.) or more and $0.55\times 10^{-5}$ (m/° C.) or less. Incidentally, the same resin material is selected as the resin material constituting the developing device frame 30 and the resin material constituting the doctor blade 36, the linear expansion coefficient difference ($\alpha 2-\alpha 1$) becomes zero.

Incidentally, when the adhesive A is applied onto the doctor blade 36 and the developing device frame 30, the doctor blade 36 and the developing device frame 30 on which the adhesive A is applied fluctuate in linear expansion coefficient. However, a volume itself of the adhesive A applied onto the doctor blade 36 and the developing device frame 30 is very small, so that the influence thereof on a dimensional fluctuation due to the temperature change with respect to a thickness direction of the adhesive A is at a negligible level. For that reason, when the adhesive A is applied onto the doctor blade 36 and the developing device frame 30, the deformation of the doctor blade 36 in the warping direction due to the fluctuation in linear expansion coefficient difference ($\alpha 2-\alpha 1$) is at a negligible level.

Similarly, the cover frame 40 is fixed to the developing device frame 30, and therefore, when the deformation amounts of the developing device frame 30 and the cover frame 40 due to the temperature change are different from each other, the deformation of the cover frame 40 in the warping direction heads to the fluctuation in magnitude of the SB gap G. The linear expansion coefficient of the resin material constituting the developing device frame 30 including the sleeve supporting portion 42 and the blade mounting portion 41 is $\alpha 2$ (m/° C.), and the linear expansion coefficient of the resin material constituting the cover frame 40 is $\alpha 3$ (m/° C.). Further, a difference of the linear expansion coefficient $\alpha 3$ of the resin material constituting the cover frame 40 from the linear expansion coefficient $\alpha 2$ of the resin material constituting the developing device frame 30 including the sleeve supporting portion 42 and the blade mounting portion 41 is hereinafter referred to as a linear expansion coefficient difference ($\alpha 3-\alpha 2$).

At this time, similarly as in the case of Table 1, there is a need that the linear expansion coefficient difference ($\alpha 3-\alpha 2$) satisfies the following relationship (2):

$$-0.45\times10^{-5}\ (\text{m/° C.})\leq\alpha 3-\alpha 2\leq 0.55\times10^{-5}\ (\text{m/° C.}) \quad (2).$$

Therefore, the resin material constituting the developing device frame 30 and the resin material constituting the cover frame 40 may only be required to be selected so that the linear expansion coefficient difference ($\alpha 3-\alpha 2$) is $-0.45\times10^{-5}$ (m/° C.) or more and $0.55\times10^{-5}$ (m/° C.) or less. Incidentally, the same resin material is selected as the resin material constituting the developing device frame 30 and the resin material constituting the cover frame 40, the linear expansion coefficient difference ($\alpha 3-\alpha 2$) becomes zero.

(Developer Pressure)

Figure 11:
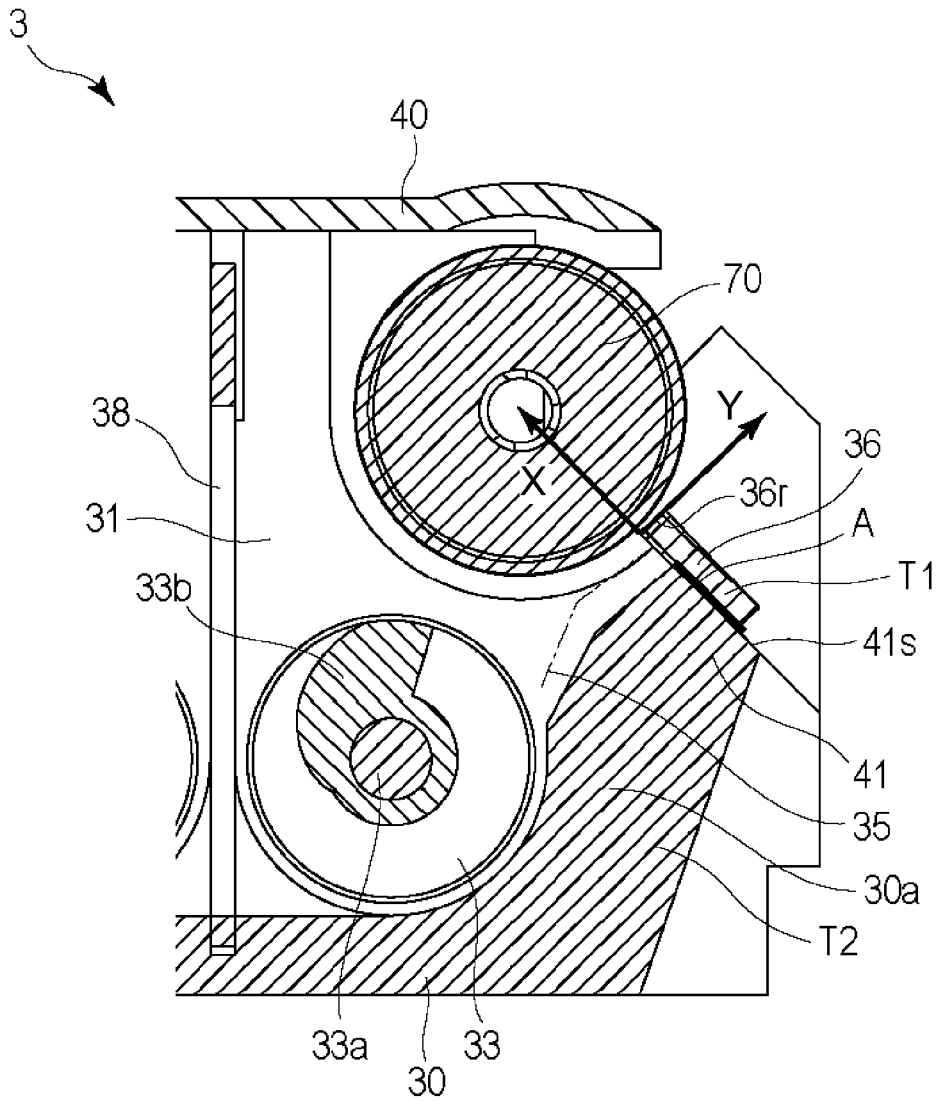
FIG. 11 is a sectional view for illustrating deformation of the resin-made doctor blade due to developer pressure.

Then, the deformation of the doctor blade 36 resulting from application, to the doctor blade 36, of the developer pressure generating from a flow of the developer will be described using a sectional view of FIG. 11. FIG. 11 is the sectional view of the developing device 3 in a cross-section (cross-section H of FIG. 2) perpendicular to the rotational axis of the developing sleeve 70. Further, FIG. 11 shows a structure of a neighborhood of the doctor blade 36 fixed to the blade mounting portion 41 of the developing device frame 30 with the adhesive A.

As shown in FIG. 11, a line connecting a closest position of the doctor blade 36 to the developing sleeve 70 on the coating amount regulating surface 36*r* is an X-axis. At this time, the doctor blade 36 is long in length with respect to the X-axis and is high in rigidity in cross-section along the X-axis. Further, as shown in FIG. 11, a proportion of a cross-sectional area T1 of the doctor blade 36 to a cross-sectional area T2 of a wall portion 30*a* of the developing device frame 30 positioned in the neighborhood of the developer guiding portion 35 is small.

As described above, the rigidity of the developing device frame 30 (alone) is made higher than the rigidity of the doctor blade 36 (alone) by ten times or more. Accordingly, in a state in which the doctor blade 36 is fixed to the blade mounting portion 41 of the developing device frame 30, the rigidity of the developing device frame 30 is predominant over the rigidity of the doctor blade 36. As a result, during the image forming operation, a displacement amount (maximum flexure amount) of the coating amount regulating surface 36*r* of the doctor blade 36 when the developer pressure is applied to the doctor blade 36 is substantially equivalent to a displacement amount (maximum flexure amount) of the developing device frame 30.

During the image forming operation, the developer scooped from the first feeding screw 33 passes through the developer guiding portion 35 and is fed to the surface of the developing sleeve 70. Thereafter, even when a layer thickness of the developer is regulated to the magnitude of the SB gap G by the doctor blade 36, the doctor blade 36 is subjected to the developer pressure from various directions. As shown in FIG. 11, when a direction perpendicular to the X-axis direction (a direction in which the SB gap G is defined) is a Y-axis direction, the developer pressure along the Y-axis direction is perpendicular to the blade mounting surface 41*s* of the developing device frame 30. That is, the developer pressure with respect to the Y-axis direction is a force for peeling off the doctor blade 36 of the blade mounting surface 41*s*. Therefore, a binding force by the adhesive A is required to be sufficiently larger than the developer pressure with respect to the Y-axis direction. Therefore, in consideration of the force for peeling off the doctor blade 36 of the blade mounting surface 41*s* by the developer pressure and of an adhesive force of the adhesive A, an adhesive area and application thickness of the adhesive A onto the blade mounting surface 41*s* are optimized.

(Structure of Developing Device According to First Embodiment)

As described above, in the developing device 3 including the doctor blade 36 made of the resin material and the developing device frame 30 made of the resin material, a constitution in which the doctor blade 36 made of the resin material is mounted and fixed to the blade mounting portion 41 of the developing device frame 30 made of the resin material would be considered.

Further, as described above, correspondingly to the increase in width of the sheet S on which the image is to be formed, the longitudinal length of the maximum image region of the doctor blade 36 increases. Further, correspondingly to the increase in longitudinal length of the maximum image region of the doctor blade 36, the longitudinal length of the blade mounting surface 41*s* increases.

In the case where the developing device frame 30 having the blade mounting surface 41*s* which has a large longitudinal length is molded with a resin material, a degree of unevenness is liable to become large, so that there is a tendency that flatness (JIS B0021) of the blade mounting surface 41*s* becomes large. This is because in general, with an increasing longitudinal length of the resin molded product, a variation in flatness of the resin molded product is liable to occur with respect to the longitudinal direction of the resin molded product.

Further, in the case where the developing device frame 30 having the blade mounting surface 41*s* which has a widthwise length larger than a predetermined value is molded with a resin material, sink marks are liable to generate on the blade mounting surface 41*s*, so that there is a tendency that the flatness of the blade mounting surface 41*s* becomes large. This is because in general, with an increasing thickness of the resin molded product, a degree of generation of a difference in progress of heat contraction between an inside and an outside of the resin molded product becomes large when the resin material which was thermally expanded during molding is thermally contracted.

In the case where the flatness of the blade mounting surface 41*s* is large, there is a tendency that the magnitude of the SB gap G in a state that the doctor blade 36 is mounted on the blade mounting surface 41*s* having the large flatness is liable to be different with respect to the longitudinal direction of the developing sleeve 70. When the magnitude of the SB gap G is different with respect to the longitudinal direction of the developing sleeve 70, there is a liability that with respect to the longitudinal direction of the developing sleeve 70, unevenness occurs in an amount of the developer carried on the surface of the developing sleeve 70. For this reason, in the case where the doctor blade 36 made of the resin material is fixed to the developing device frame 30 made of the resin material and having the blade mounting surface 41*s* which has the large longitudinal length, it is required that the flatness of the blade mounting surface 41*s* is made small. This is because by decreasing the flatness of the blade mounting surface 41*s*, the magnitude of the SB gap G is caused to fall within a predetermined range over the longitudinal direction of the developing sleeve 70.

The flatness of the blade mounting surface 41*s* can be decreased by subjecting the developing device frame 30 made of the resin material and having the blade mounting surface 41*s* which has the large longitudinal length to manufacturing and secondary fabrication with high accuracy using a high-precision resin material. On the other hand, in the case where the developing device frame 30 made of the resin material and having the blade mounting surface 41*s* which has the large longitudinal length is manufactured with accuracy of a general-purpose resin molded product, in order to decrease the flatness of the blade mounting surface 41*s*, it would be considered that the widthwise length of the blade mounting surface 41*s* is made a predetermined value or less. Therefore, in the case where the doctor blade 36 is fixed to the developing device frame 30 made of the resin material and having the blade mounting surface 41*s* which has the widthwise length not more than the predetermined value, the following is required. That is, an attitude of the resin-made doctor blade 36 mounted on the blade mounting surface 41*s* when the resin-made doctor blade 36 is fixed to the resin-made developing device frame 30 is stabilized.

Therefore, in this embodiment (First Embodiment), in a constitution in which the resin-made doctor blade is fixed to the developing device frame with accuracy of the general-purpose resin molded product, the decrease in flatness of the blade mounting surface and stabilization of the attitude of the doctor blade mounted on the blade mounting surface are compatibly realized. In this embodiment as described above, by employing a simple constitution, while decreasing the flatness of the blade mounting surface, the attitude of the doctor blade mounted on the blade mounting surface when the doctor blade made of the resin material is fixed to the developing device frame made of the resin material is stabilized. In the following, details will be described.

A constitution of the blade mounting surface in this embodiment will be described using a perspective view of FIG. 12. Further, a constitution of the developing device according to this embodiment will be described using a sectional view of FIG. 13 and an enlarged view of FIG. 14.

Figure 12:
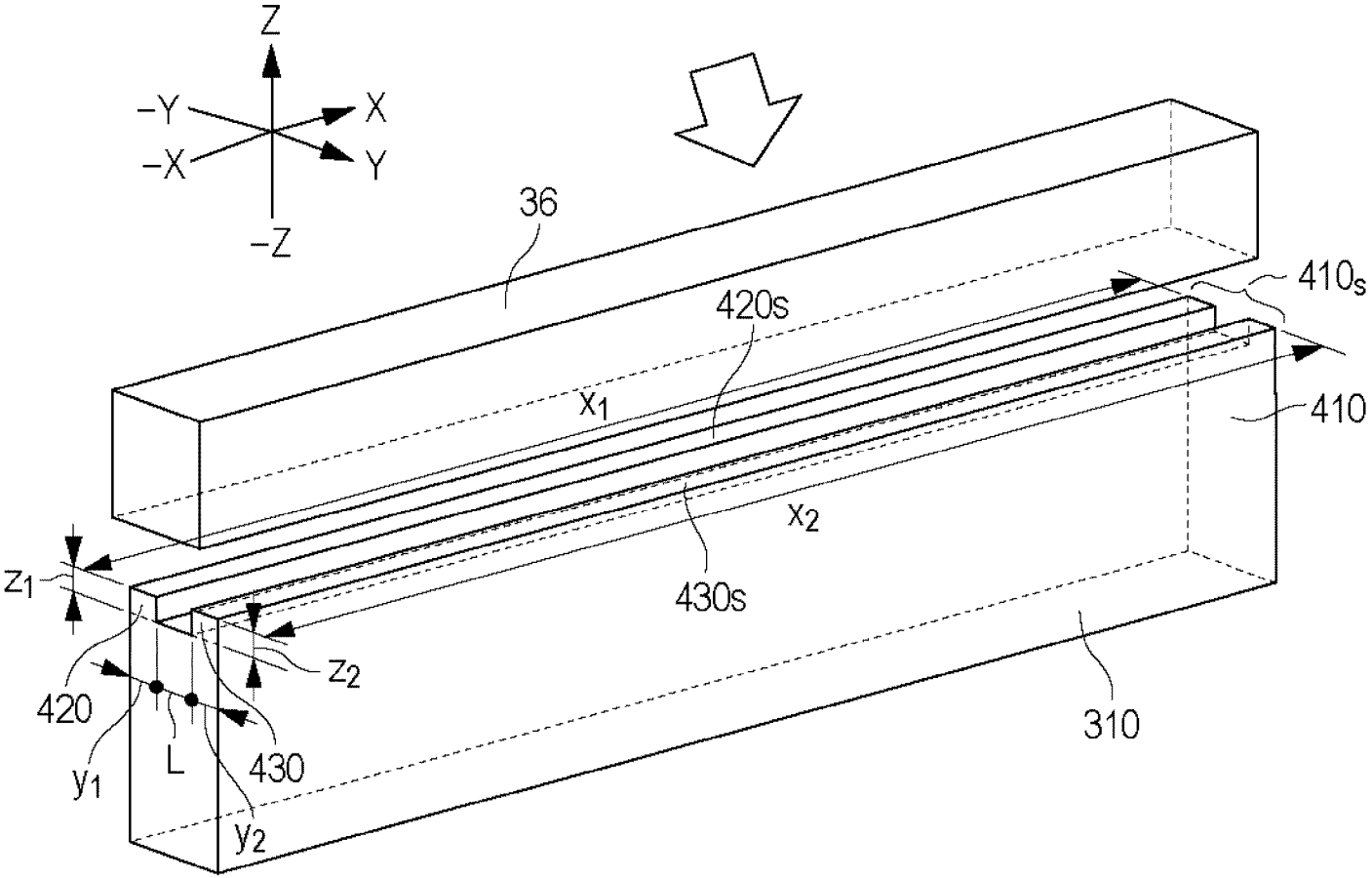
FIG. 12 is a perspective view showing a structure of a blade mounting surface of a developing device frame according to a First Embodiment.
Figure 13:
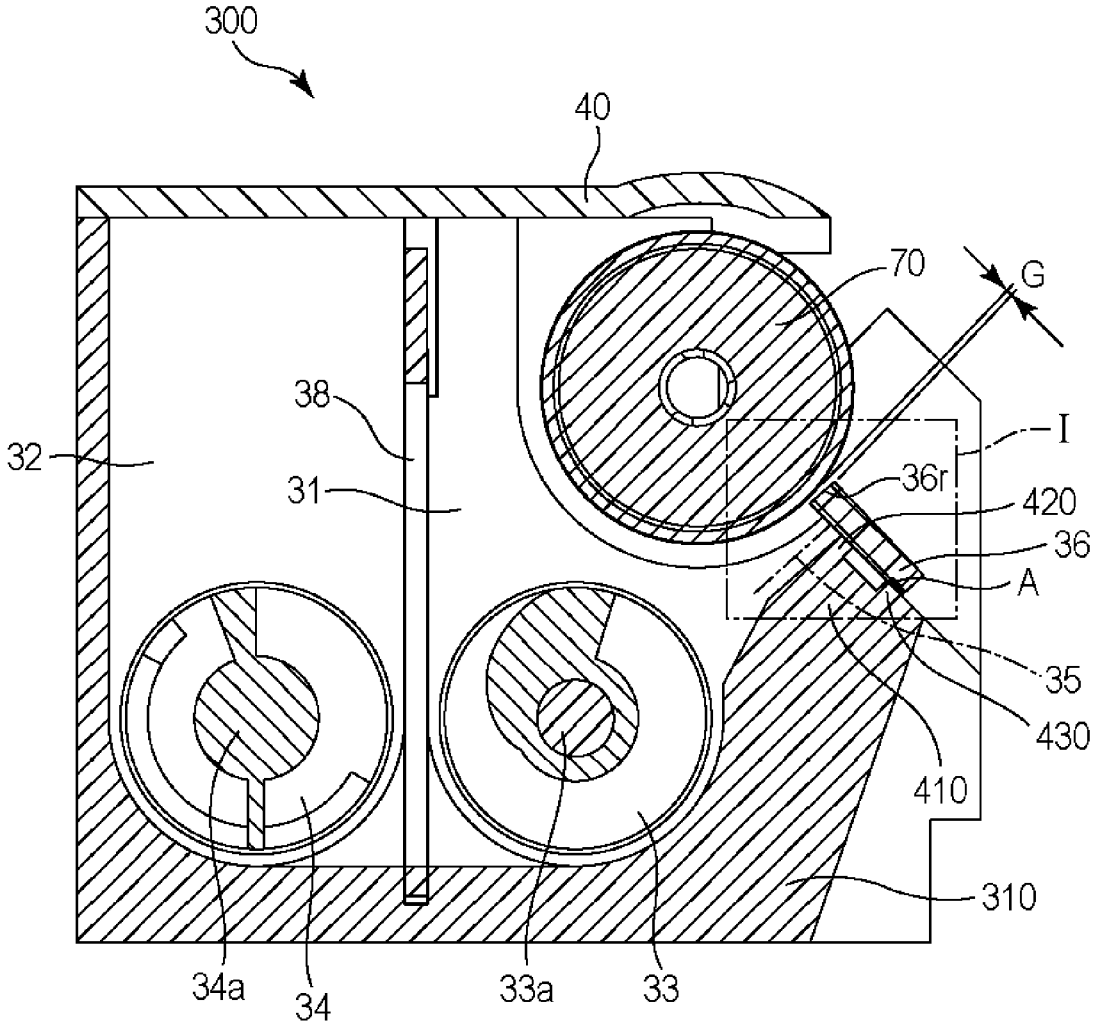
FIG. 13 is a sectional view showing a structure of a developing device according to the First Embodiment.
Figure 14:
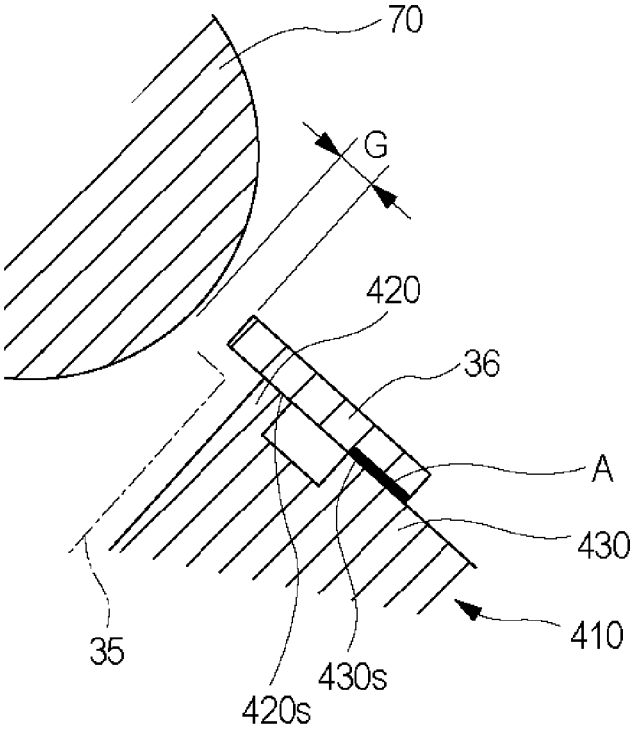
FIG. 14 is a sectional view (enlarged view) showing the structure of the developing device according to the First Embodiment.

FIG. 12 shows a phantom state in which the doctor blade 36 is floated from a blade mounting portion 410 and is the perspective view for illustrating a structure of a blade mounting surface 410*s*. FIG. 13 is the sectional view of a developing device 300 in a cross section perpendicular to the rotational axis of the developing sleeve 70. FIG. 14 is a sectional view (enlarged view) of the developing device 300 in the neighborhood (region I of FIG. 13) of the blade mounting surface 410*s*.

In FIG. 12, constituent elements to which the same reference numerals or symbols as those in FIG. 6 are added are the same as those in FIG. 6. In the constitution of the blade mounting surface 410*s* in this embodiment, a difference from the constitution of the blade mounting surface 41*s* described above with reference to FIG. 6 will be principally described. Further, in FIGS. 13 and 14, constituent elements to which the same reference numerals or symbols as those in FIG. 4 are added are the same as those in FIG. 4. In the constitution of the developing device 300 according to this embodiment, a difference from the constitution of the developing device 3 described above with reference to FIG. 4 will be principally described.

In this embodiment, the doctor blade 36 is fixed to a developing device frame 310 manufactured with accuracy of the general-purpose resin molded product and having the blade mounting surface 410*s* which has the large longitudinal length. In such a constitution, in this embodiment, decrease in flatness of the blade mounting surface 410*s* and stabilization of an attitude of the doctor blade 36 mounted on the blade mounting surface 410*s* are compatibly realized.

As shown in FIG. 12, the developing device frame 310 is provided with a first blade supporting portion (first rib) 420 and a second blade supporting portion (second rib) 430 which are formed along the longitudinal direction (a direction parallel to the rotational axis of the developing sleeve 70) of the developing sleeve 70 at portions thereof projecting from the blade mounting portion 410 and which are provided for supporting the doctor blade 36. Further, when the developing device 300 is seen in a cross section perpendicular to the rotational axis of the developing sleeve 70, with respect to a direction of the doctor blade 36 from a position closest to the developing sleeve 70 toward a rotation center of the developing sleeve 70, the first blade supporting portion 420 and the second blade supporting portion 430 are provided at a predetermined interval therebetween. Further, the blade mounting surface 410*s* is constituted by a first blade supporting surface 420*s*, of the first blade supporting portion 420, capable of supporting the doctor blade 36 and by a second blade supporting surface 430*s*, of the second blade supporting portion 430, capable of supporting the doctor blade 36.

The first blade supporting surface 420*s* is formed over a substantially entire region of the maximum image region of the photosensitive drum 1. Similarly, the second blade supporting surface 420*s* is formed over a substantially entire region of the maximum image region of the photosensitive drum 1. Incidentally, when each of the first blade supporting surface 420*s* and the second blade supporting surface 430*s* is formed over a region which is 90% or more of the maximum image region of the photosensitive drum 1, the associated blade supporting surface is regarded as being formed over the substantially entire region of the maximum image region of the photosensitive drum 1. Further, in order to decrease the flatness of the first blade supporting surface 420*s*, a length of the first blade supporting surface 420*s* with respect to the widthwise direction (i.e., the direction of the doctor blade 36 from the position closest to the developing sleeve 70 toward the rotation center of the developing sleeve 70) of the first blade supporting surface 420*s* is made 3.0 mm or less. Similarly, in order to decrease the flatness of the second blade supporting surface 430*s*, a length of the second blade supporting surface 430*s* with respect to the widthwise direction (i.e., the direction of the doctor blade 36 from the position closest to the developing sleeve 70 toward the rotation center of the developing sleeve 70) of the second blade supporting surface 430*s* is made 3.0 mm or less.

By employing such a constitution, as shown in FIGS. 13 and 14, the doctor blade 36 is supported by the first blade supporting surface 420*s* and the second blade supporting surface 430*s* and thus is mounted on the blade mounting portion 410. Therefore, even when both the length of the first blade supporting surface 420*s* with respect to the widthwise direction and the length of the second blade supporting surface 430*s* with respect to the widthwise direction are a predetermined value or less, the attitude of the doctor blade 36 mounted on the blade mounting portion 410 when the doctor blade 36 is fixed to the blade mounting portion 410 is stabilized. Further, the magnitude of the SB gap G in a state that the doctor blade 36 is supported by the first blade supporting surface 420*s* and the second blade supporting surface 430*s* and thus is mounted on the blade mounting portion 410 can be caused to fall within a predetermined range over the longitudinal direction of the developing sleeve 70.

In FIG. 12, $x_1$ represents a length of the first blade supporting surface 420*s* with respect to the longitudinal direction of the first blade supporting surface 420*s*, and $y_1$ represents a length of the first blade supporting surface 420*s* with respect to the widthwise direction of the first blade supporting surface 420*s*. Further, $z_1$ represents a length of the first blade supporting portion 420 projecting from the developing device frame 310. In FIG. 12, $x_2$ represents a length of the second blade supporting surface 430*s* with respect to the longitudinal direction of the second blade supporting surface 430*s*, and $y_2$ represents a length of the second blade supporting surface 430*s* with respect to the widthwise direction of the second blade supporting surface 430*s*. Further, $z_2$ represents a length of the second blade supporting portion 430 projecting from the developing device frame 310. Further, L represents an interval between the first blade supporting surface 420*s* and the second blade supporting surface 430*s*.

When a lightening portion (a recessed portion formed between the first blade supporting portion 420 and the second blade supporting portion 430) of the blade mounting portion 410 is molded with a resin material with the accuracy of the general-purpose resin molded product, in order to ensure strength of a metal mold, the following relational formulas 3 and 4 may preferably be satisfied.

$$z_1<2L,\ z_1<2x_1 \quad \text{(formula 3)}$$

$$z_2<2L,\ z_2<2x_2 \quad \text{(formula 4)}$$

In this embodiment, $z_1$ is 0.2 mm or more, and $y_1$ is 3.0 mm or less. In order to decrease the flatness of the first blade supporting surface 420*s*, $y_1$ may preferably be made not more than a basic thickness of the developing device frame 310 and made not less than 0.7 mm. Further, in this embodiment, $z_2$ is 0.2 mm or more, and $y_2$ is 3.0 mm or less. In order to decrease the flatness of the second blade supporting surface 430*s*, $y_2$ may preferably be made not more than the basic thickness of the developing device frame 310 and made not less than 0.7 mm. Further, in this embodiment, in order not to be disadvantageous from the viewpoint of mass-productivity while enhancing molding strength, the basic thickness of the developing device frame 310 is made 1.0 mm or more and 3.0 mm or less.

In this embodiment, the first blade supporting surface 420*s* is formed over the substantially entire region of the maximum image region of the photosensitive drum 1 and $x_1$ is about 300 mm. Further, in this embodiment, the second blade supporting surface 430*s* is formed over the substantially entire region of the maximum image region of the photosensitive drum 1 and $x_2$ is about 300 mm. Further, in this embodiment, $z_1$ is about 0.5 mm, $z_2$ is about 0.5 mm, and L is about 3.0 mm.

As shown in FIGS. 13 and 14, the doctor blade 36 is supported by the first blade supporting portion 420 and the second blade supporting portion 430 and is fixed to the blade mounting portion 410 with the adhesive A. In this embodiment, the doctor blade 36 is fixed to the blade mounting portion 410 in a flexed state so that the magnitude of the SB gap G falls within the predetermined range over the entire region of the maximum image region of the doctor blade 36. For this reason, in order to prevent a degree of flexure from returning to an original state, the doctor blade 36 may desirably be fixed to the blade mounting portion 410 with the adhesive A over the substantially entire region of a maximum image region of the doctor blade 36.

In the case where the doctor blade 36 is fixed to the blade mounting portion 410 with the adhesive A, the adhesive A may only be required to be applied onto at least one of the first blade supporting surface 420*s* and the second blade supporting surface 430*s*. In an example of FIGS. 13 and 14, the adhesive A is applied on the second blade supporting surface 430*s*. Then, the doctor blade 36 is mounted on the blade mounting portion 410 by being supported by the first blade supporting surface 420*s* and the second blade supporting surface 430*s*. As a result, in a perpendicular to that the attitude of the doctor blade 36 is stabilized, the doctor blade 36 can be fixed to the blade mounting portion 410 with the adhesive A. Incidentally, in this embodiment, as a means for fixing the doctor blade 36 to the blade mounting portion 410, an example using the adhesive A was described, but the present invention is not limited thereto. A modified example in which the doctor blade 36 is fixed to the blade mounting portion 410 by using a double-side tape or welding may also be employed so long as a fixing strength capable of causing the magnitude of the SB gap G to fall within the predetermined range when developer pressure is applied to the doctor blade 36.

In the First Embodiment described above, in the constitution in which the doctor blade made of the resin material is fixed to the developing device frame with the accuracy of the general-purpose resin molded product, the decrease in flatness of the blade mounting surface and the stabilization of the attitude of the doctor blade mounted on the blade mounting surface were compatibly realized. In such First Embodiment, by a simple constitution, the attitude of the doctor blade mounted on the blade mounting surface when the doctor blade made of the resin material is fixed to the developing device frame made of the resin material can be stabilized while decreasing the flatness of the blade mounting surface.

Second Embodiment

In the first Embodiment described above, the constitution in which while decreasing the flatness of the blade mounting surface of the developing device frame made of the resin material, the attitude of the regulating blade mounted on the blade mounting surface of the developing device frame when the regulating blade made of the resin material is fixed to the developing device frame made of the resin material is stabilized was described. In this embodiment, a constitution in which while decreasing flatness of the surface-to-be-mounted of the regulating blade made of the resin material, the attitude of the regulating blade having the surface-to-be-mounted mounted on the developing device frame made of the resin material when the regulating blade made of the resin material is fixed to the developing device frame made of the resin material is stabilized will be described.

In this embodiment, in the case where the regulating blade made of the resin material and having the large longitudinal length of the maximum image region is manufactured with the accuracy of the general-purpose resin molded product, in order to decrease the flatness of the surface-to-be-mounted of the regulating blade, a widthwise length of the surface-to-be-mounted of the regulating blade is made a predetermined value or less. Incidentally, the surface-to-be-mounted of the regulating blade refers to a surface of the regulating blade where the regulating blade is to be mounted on the developing device frame.

A constitution of a blade mounting surface surface-to-be-mounted of a doctor blade in this embodiment will be described using a perspective view of FIG. 15. Further, a constitution of the developing device according to this embodiment will be described using a sectional view of FIG. 16 and an enlarged view of FIG. 17.

Figure 15:
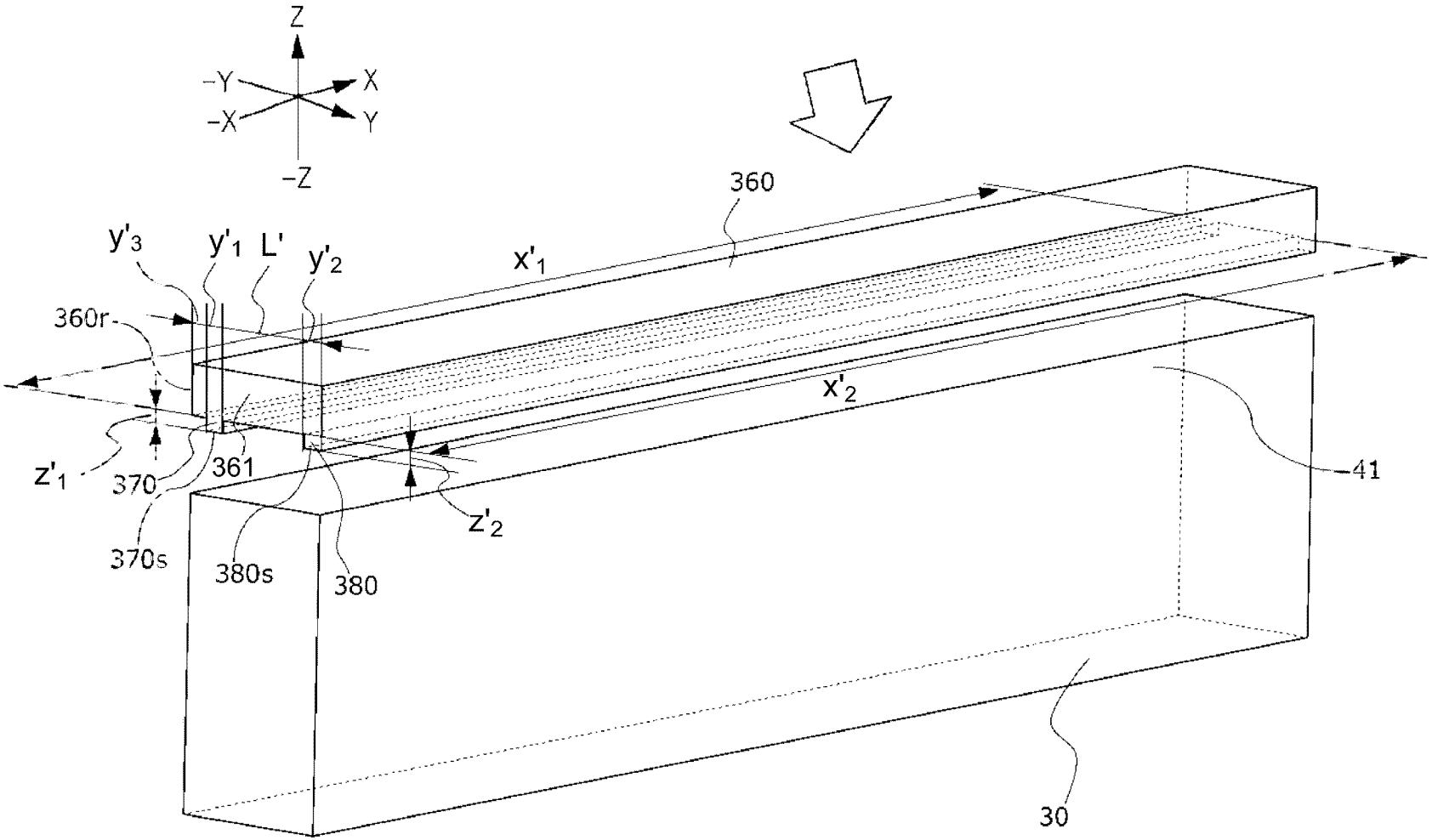
FIG. 15 is a perspective view showing a structure of a surface-to-be-mounted of a doctor blade according to a Second Embodiment.
Figure 16:
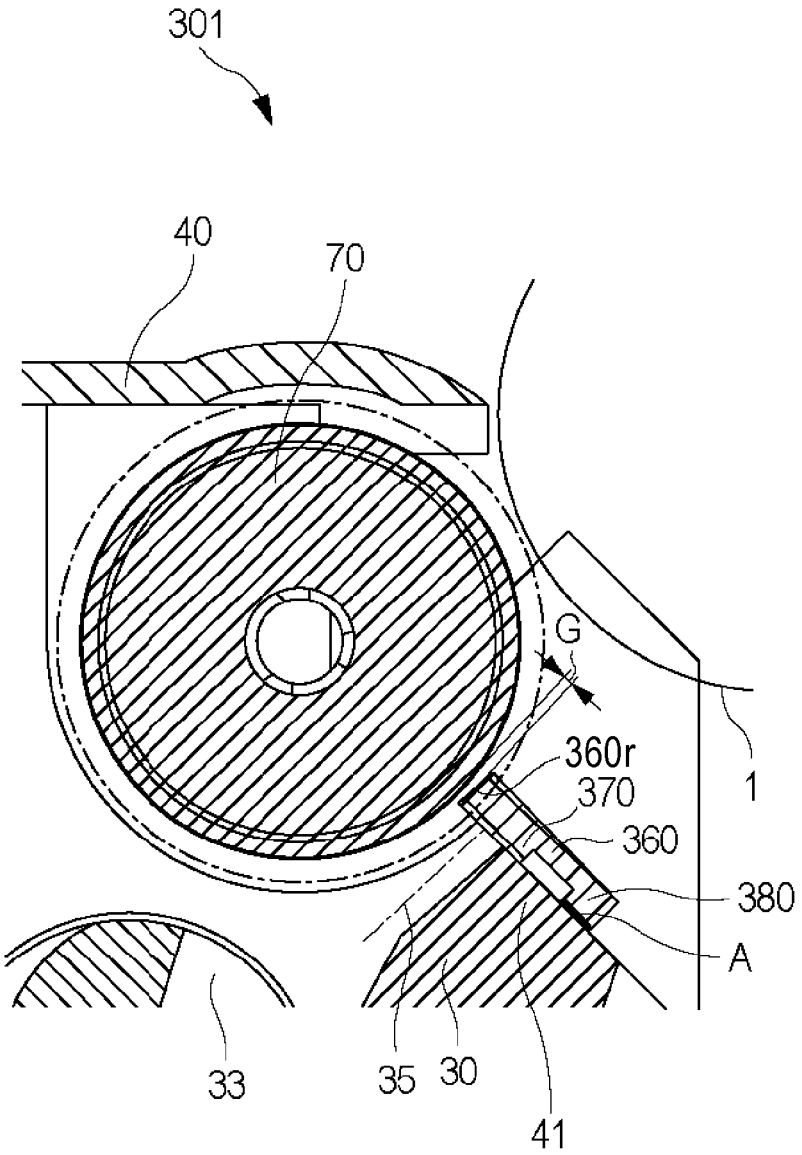
FIG. 16 is a sectional view showing a structure of a developing device according to the Second Embodiment.
Figure 17:
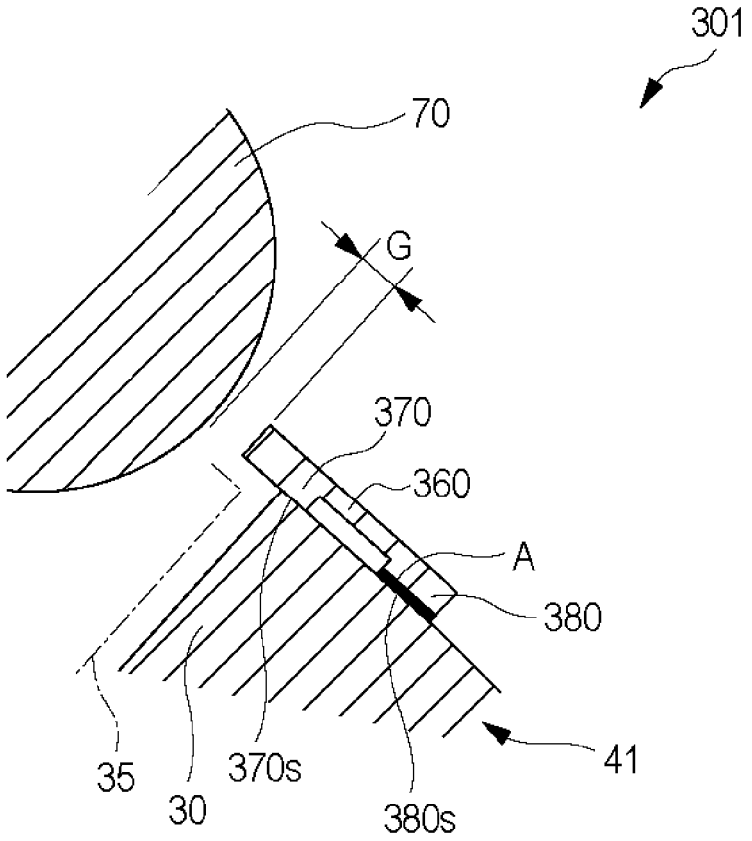
FIG. 17 is a sectional view (enlarged view) showing the structure of the developing device according to the Second Embodiment.

FIG. 15 shows a phantom state in which a doctor blade 360 is floated from the blade mounting portion 41 and is the perspective view for illustrating a structure of a surface-to-be-mounted blade (surfaces-to-be-supported 370*s* and 380*s*) of the doctor blade 360. FIG. 16 is the sectional view of a developing device 301 in a cross section perpendicular to the rotational axis of the developing sleeve 70. FIG. 17 is a sectional view (enlarged view) of the developing device 301 in the neighborhood of the blade surfaces-to-be-supported 370*s* and 380*s* of the doctor blade 360.

In FIG. 15, constituent elements to which the same reference numerals or symbols as those in FIG. 12 are added are the same as those in FIG. 12. Further, in FIGS. 16 and 17, constituent elements to which the same reference numerals or symbols as those in FIGS. 13 and 14 are added are the same as those in FIGS. 13 and 14. In the constitution of the developing device 301 according to this embodiment, a difference from the constitution of the developing device 300 described in the First Embodiment will be principally described.

As shown in FIG. 15, the doctor blade 360 is provided with a first portion-to-be-supported (first rib) 370 and a second portion-to-be-supported (second rib) 380 which are formed along the longitudinal direction (a direction parallel to the rotational axis of the developing sleeve 70) of the developing sleeve 70 at portions thereof projecting from a base portion 361 constituted with a basic thickness of the doctor blade 360 and which are provided for being supported by the blade mounting portion 41. Further, when the developing device 301 is seen in a cross section perpendicular to the rotational axis of the developing sleeve 70, with respect to a direction of the doctor blade 360 from a position closest to the developing sleeve 70 toward a rotation center of the developing sleeve 70, the first portion-to-be-supported 370 and the second portion-to-be-supported 380 are provided at a predetermined interval therebetween. Further, the first portion-to-be-supported 370 has a first surface-to-be-supported 370*s* capable of being supported by the blade mounting portion 41, and the second portion-to-be-supported 380 has a second surface-to-be-supported 380*s* capable of being supported by the blade mounting portion 41.

The first surface-to-be-supported 370*s* is formed over a substantially entire region of the maximum image region of the photosensitive drum 1. Similarly, the second surface-to-be-supported 380*s* is formed over a substantially entire region of the maximum image region of the photosensitive drum 1. Incidentally, when each of the first surface-to-be-supported 370*s* and the second surface-to-be-supported 380*s* is formed over a region which is 90% or more of the maximum image region of the photosensitive drum 1, the associated blade supporting surface is regarded as being formed over the substantially entire region of the maximum image region of the photosensitive drum 1. Further, in order to decrease the flatness of the first surface-to-be-supported 370*s*, a length of the first surface-to-be-supported 370*s* with respect to the widthwise direction (i.e., the direction of the doctor blade 36 from the position closest to the developing sleeve 70 toward the rotation center of the developing sleeve 70) of the first blade supporting surface 420*s* is made 3.0 mm or less. Similarly, in order to decrease the flatness of the second surface-to-be-supported 380*s*, a length of the second surface-to-be-supported 380*s* with respect to the widthwise direction (i.e., the direction of the doctor blade 36 from the position closest to the developing sleeve 70 toward the rotation center of the developing sleeve 70) of the second blade supporting surface 430*s* is made 3.0 mm or less.

By employing such a constitution, as shown in FIGS. 16 and 17, each of the first surface-to-be-supported 370*s* and the second surface-to-be-supported 380*s* is supported by the blade mounting portion 41, so that the doctor blade 360 is mounted on the blade mounting portion 41. Therefore, even when both the length of the first surface-to-be-supported 370*s* with respect to the widthwise direction and the length of the second surface-to-be-supported 380*s* with respect to the widthwise direction are a predetermined value or less, the attitude of the doctor blade 360 mounted on the blade mounting portion 41 when the doctor blade 360 is fixed to the blade mounting portion 41 is stabilized. Further, the magnitude of the SB gap Gin a state that the first surface-to-be-supported 370*s* and the second surface-to-be-supported 380*s* are supported by the blade mounting portion 41 and thus the doctor blade 360 is mounted on the blade mounting portion 41 can be caused to fall within a predetermined range over the longitudinal direction of the developing sleeve 70.

In FIG. 15, $x'_1$ represents a length of the first surface-to-be-supported 370*s* with respect to the longitudinal direction of the first surface-to-be-supported 370*s* and $y'_1$ represents a length of the first surface-to-be-supported 370*s* with respect to the widthwise direction of the first surface-to-be-supported 370*s*. Further, $z'_1$ represents a length of the first portion-to-be-supported 370 projecting from the base portion 361 of the doctor blade 360. In FIG. 15, $x'_2$ represents a length of the second surface-to-be-supported 380*s* with respect to the longitudinal direction of the second surface-to-be-supported 380*s*, and $y'_2$ represents a length of the second surface-to-be-supported 380*s* with respect to the widthwise direction of the second surface-to-be-supported 380*s*. Further, $z'_2$ represents a length of the second portion-to-be-supported 380 projecting from the base portion 361 of the doctor blade 360. Further, L' represents an interval between the first surface-to-be-supported 370*s* and the second surface-to-be-supported 380*s*. Further, $y'_3$ represents an interval between the first portion-to-be-supported 370 and a coating amount regulating surface 360*r* (position of the doctor blade 360 closest to the developing sleeve 70) as a regulating portion for regulating an amount of the developer carried on the surface of the developing sleeve 70.

When a lightening portion (a recessed portion formed between the first portion-to-be-supported 370 and the second portion-to-be-supported 380) of the doctor blade 360 is molded with a resin material with the accuracy of the general-purpose resin molded product, in order to ensure strength of a metal mold, the following relational formulas 5 and 6 may preferably be satisfied.

$$z'_1<2L',\ z'_1<2x'_1 \quad \text{(formula 5)}$$

$$z'_2<2L',\ z'_2<2x'_2 \quad \text{(formula 6)}$$

In this embodiment, $z'_1$ is 0.2 mm or more, and $y'_1$ is 3.0 mm or less. In order to decrease the flatness of the first surface-to-be-supported 370*s*, $y'_1$ may preferably be made not more than a basic thickness of developing device frame 310 and made not less than 0.7 mm. Further, in this embodiment, $z'_2$ is 0.2 mm or more, and $y'_2$ is 3.0 mm or less. In order to decrease the flatness of the second surface-to-be-supported 380*s*, $y'_2$ may preferably be made not more than the basic thickness of the doctor blade 360 and made not less than 0.7 mm. Further, in this embodiment, in order not to be disadvantageous from the viewpoint of mass-productivity while enhancing molding strength, the basic thickness of the doctor blade 360 is made 1.0 mm or more and 3.0 mm or less.

In this embodiment, the first surface-to-be-supported 370*s* is formed over the substantially entire region of the maximum image region of the photosensitive drum 1, and $x'_1$ is about 300 mm. Similarly, in this embodiment, the second surface-to-be-supported 380*s* is formed over the substantially entire region of the maximum image region of the photosensitive drum 1, and $x'_2$ is about 300 mm. Further, in this embodiment, $z'_1$ is about 0.5 mm, $z'_2$ is about 0.5 mm, and L' is about 3.0 mm.

Further, in this embodiment, y'3 is 0.6 mm or more. This is because even in the case where sink marks are generated on the doctor blade 360 due to the first portion-to-be-supported 370 when the doctor blade 360 is molded with a resin material, an influence of the sink marks on the coating amount regulating surface 360*r* is reduced. That is, by making $y'_3$ not less than 0.6 mm, the magnitude of the SB gap G can be caused to fall within the predetermined range over the longitudinal direction of the developing sleeve 70.

As shown in FIGS. 16 and 17, the first portion-to-be-supported 370 and the second portion-to-be-supported 380 are supported by the blade mounting portion 41, so that the doctor blade 360 is fixed to the blade mounting portion 41 with the adhesive A. In this embodiment, the doctor blade 360 is fixed to the blade mounting portion 41 in a flexed state so that the magnitude of the SB gap G falls within the predetermined range over the entire region of the maximum image region of the doctor blade 360. For this reason, in order to prevent a degree of flexure from returning to an original state, the doctor blade 360 may desirably be fixed to the blade mounting portion 41 with the adhesive A over the substantially entire region of a maximum image region of the doctor blade 360.

In the case where the doctor blade 360 is fixed to the blade mounting portion 41 with the adhesive A, the adhesive A may only be required to be applied onto at least one of the first surface-to-be-supported 370*s* and the second surface-to-be-supported 380*s*. In an example of FIGS. 16 and 17, the adhesive A is applied on the second surface-to-be-supported 380*s*. Then, the doctor blade 360 is mounted on the blade mounting portion 41 by supporting the first surface-to-be-supported 370*s* and the second surface-to-be-supported 380*s* by the blade mounting portion 41. As a result, in a perpendicular to that the attitude of the doctor blade 360 is stabilized, the doctor blade 360 can be fixed to the blade mounting portion 41 with the adhesive A. Incidentally, in this embodiment, as a means for fixing the doctor blade 360 to the blade mounting portion 41, an example using the adhesive A was described, but the present invention is not limited thereto. A modified example in which the doctor blade 360 is fixed to the blade mounting portion 41 by using a double-side tape or welding may also be employed so long as a fixing strength capable of causing the magnitude of the SB gap G to fall within the predetermined range when developer pressure is applied to the doctor blade 360.

In the Second Embodiment described above, in the constitution in which the doctor blade with the accuracy of the general-purpose is fixed to the developing device frame made of the resin material, the decrease in flatness of the surface-to-be-mounted (surface-to-be-supported) of the doctor blade and the stabilization of the attitude of the doctor blade mounted on the blade mounting surface of the developing device frame were compatibly realized. In such Second Embodiment, by a simple constitution, the attitude of the doctor blade mounted on the blade mounting surface when the doctor blade made of the resin material is fixed to the developing device frame made of the resin material can be stabilized while decreasing the flatness of the surface-to-be-mounted (surface-to-be-supported) of the doctor blade.

Incidentally, in the Second Embodiment, the doctor blade is provided with the first portion-to-be-supported and the second portion-to-be-supported, and therefore, geometrical moment of inertia of the doctor blade increases due to the first portion-to-be-supported and the second portion-to-be-supported, so that rigidity of the doctor blade increases. On the other hand, in the First Embodiment described above, the developing device frame is provided with the first blade supporting portion and the second blade supporting portion, and therefore, different from this embodiment, there is no need that the doctor blade is provided with the first portion-to-be-supported and the second portion-to-be-supported. For this reason, in the First Embodiment, rigidity of the doctor blade can be made lower than the rigidity of the doctor blade in this embodiment.

As described above, in both of the First and Second Embodiments, the doctor blade is fixed to the blade mounting portion of the developing device frame in a state that the doctor blade is flexed so that the magnitude of the SB gap G falls within the predetermined range over the entire region of the maximum image region of the doctor blade. With lower rigidity of the doctor blade, the doctor blade is flexed more easily without increasing a force (straightness correcting force) to be imparted to the doctor blade for flexing the doctor blade. Therefore, so long as the developing device is assembled through a step of flexing the doctor blade, from a viewpoint of an assembling property of the doctor blade. The First Embodiment capable of lowering the rigidity of the doctor blade is more advantageous than the Second Embodiment.

On the other hand, in both of the First and Second Embodiments, in order to lower the rigidity of the doctor blade for the purpose of flexing the doctor blade, a metal mold is designed so that a cross-sectional area of the doctor blade is relatively decreased for decreasing geometrical moment of inertia. When the doctor blade is molded with the resin material through injection molding, in the case where the metal mold designed so as to decrease the cross-sectional area of the doctor blade is used, molding pressure has to be increased so that a melted resin material efficiently flows in the metal mold. This is because the melted resin material does not readily flow more smoothly with a decreasing cross-sectional area of a space in which the melted resin material passes. In other words, the melted resin material easily flows more smoothly with an increasing cross-sectional area of the space in which the melted resin material passes.

As described above, in this embodiment, different from the First Embodiment, the doctor blade is provided with the first portion-to-be-supported and the second portion-to-be-supported, so that in this embodiment, the cross-sectional area of the doctor blade can be made larger than that in the First Embodiment. Therefore, so long as the doctor blade is molded with the resin material in the metal mold designed so as to relatively decrease the cross-sectional area of the doctor blade, from a viewpoint of a molding property of the doctor blade, the Second Embodiment capable of increasing the cross-sectional area of the doctor blade is more advantageous than the First Embodiment.

Third Embodiment

As described above, the longitudinal length of the maximum image region of the doctor blade 36 becomes large correspondingly to the increase in width of the sheet S on which the image is to be formed. In the case where the doctor blade 36 large in longitudinal length is molded with a resin material, it is difficult to ensure the straightness of the coating amount regulating surface 36*r* of the doctor blade 36 made of resin material. Therefore, in this embodiment, in order to correct the straightness of the coating amount regulating surface 36*r* of the doctor blade 36 having the large longitudinal length to 50 μm or less, at least a part of the maximum image region of the doctor blade 36 is flexed. Then, a method in which the doctor blade 36 having the maximum image region flexed at least at the part thereof is mounted on the blade mounting portion 41 of the developing device frame 30 and then is fixed to the blade mounting portion 41 with the adhesive A is employed.

As a result, of the maximum image region of the doctor blade 36, in the region in which the doctor blade 36 is flexed for correcting the straightness of the coating amount regulating surface 36*r*, it is possible to suppress a phenomenon that the state of the doctor blade 36 is likely to be returned from a flexed state to an original state before the flexure. For this reason, in order to prevent the return of the flexure of the doctor blade 36 to the original state, the doctor blade 36 may desirably be fixed to the blade mounting portion 41 with the adhesive A over the substantially entire region of the maximum image region of the doctor blade 36.

In this embodiment, in a constitution in which the doctor blade 36 made of the resin material is mounted on the blade mounting portion 41 of the developing device frame 30 made of the resin material and is fixed to the blade mounting portion 41 with the adhesive A, the adhesive A having a predetermined thickness is, for example, applied onto the blade mounting surface 41*s* of the blade mounting portion 41. Further, when the doctor blade 36 is mounted on the blade mounting portion 41 (during adhesive bonding), predetermined pressure is applied to the doctor blade 36, so that the adhesive A having the predetermined thickness is pressed (deformed). At this time, there is a liability that the adhesive (excessive adhesive) escaping to an outside of the surface (the blade mounting surface 41*s* in this case) on which the adhesive A is applied enters an inside of the developing device frame 30. Especially, in the case where this excessive adhesive is deposited and cured on the developer guiding portion 35 of the developing device frame 30, there is a liability that a flow of the developer fed toward the SB gap fluctuates. In such a case, there is a liability that unevenness generates in amount of the developer carried on the surface of the developing sleeve 70 with respect to the longitudinal direction of the developing sleeve 70.

Therefore, in this embodiment, in the constitution in which the doctor blade made of the resin material is mounted on the blade mounting portion of the developing device frame and is fixed to the blade mounting portion with the adhesive, entrance of the adhesive into the developing device frame is suppressed when the doctor blade is mounted on the developing device frame. In the following, details will be described.

A constitution of the developing device according to this embodiment will be described using a sectional view of FIG. 18 and a sectional view (enlarged view) of FIG. 19.

Figure 18:
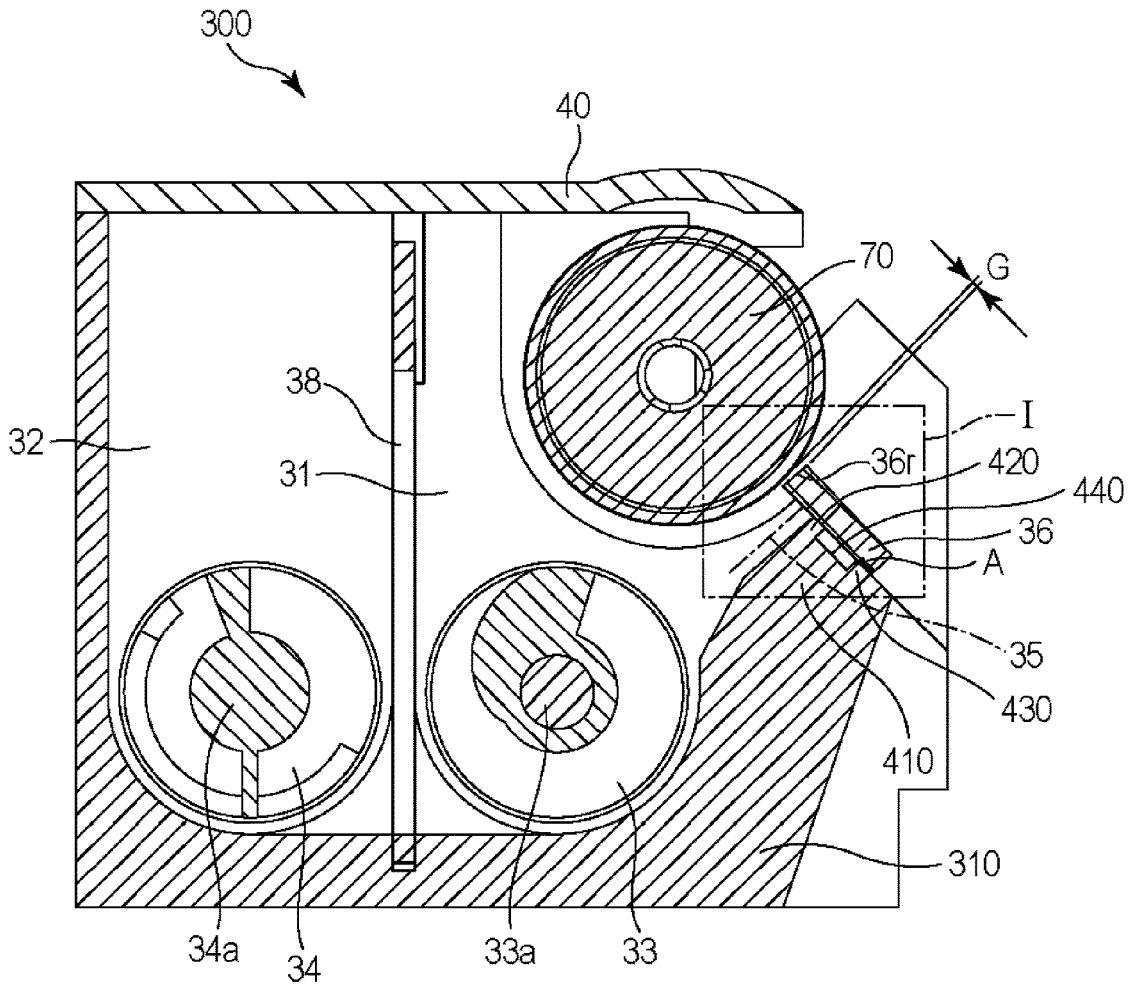
FIG. 18 is a sectional view showing a structure of a developing device according to a Third Embodiment.

FIG. 18 is the sectional view of a developing device 300 in a cross section perpendicular to the rotational axis of the developing sleeve 70. FIG. 19 is the sectional view of the developing device 300 in the cross section perpendicular to the rotational axis of the developing sleeve 70 and is the enlarged view of the developing device 300 in the neighborhood (region I of FIG. 18) of the blade mounting portion 410 (especially, the blade mounting surface 410*s*) of a developing device frame 310. In FIGS. 18 and 19, constituent elements to which the same reference numerals or symbols as those in FIG. 4 are added are the same as those in FIG. 4. In the constitution of the developing device 300 according to this embodiment, a difference from the constitution of the developing device 3 described above with reference to FIG. 4 will be principally described.

Figure 19:
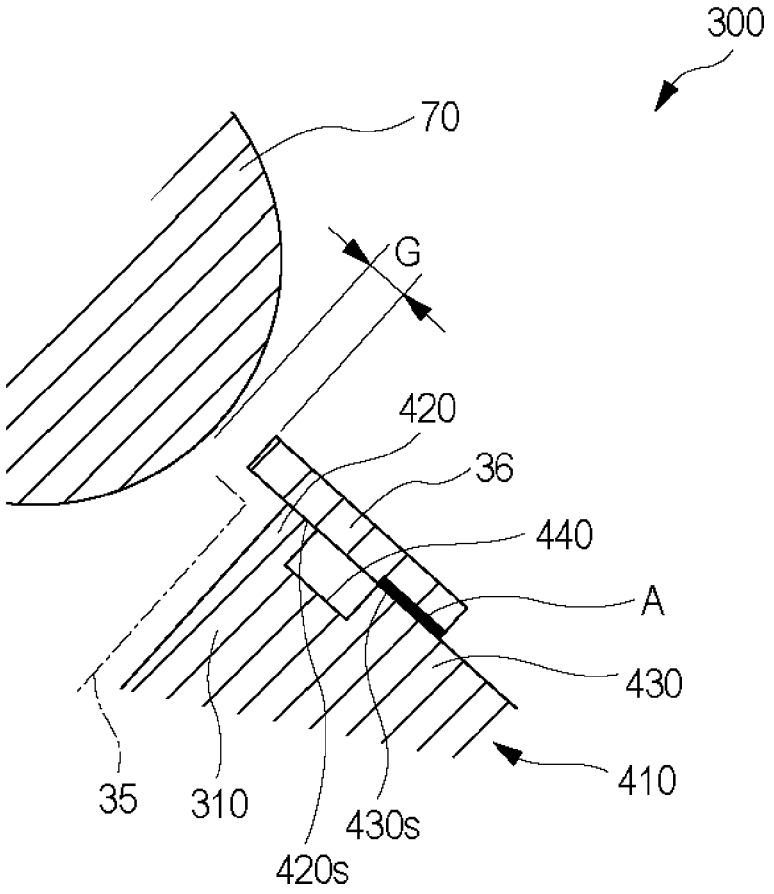
FIG. 19 is a sectional view (enlarged view) showing the structure of the developing device according to the Third Embodiment.

As shown in FIGS. 18 and 19, the blade mounting portion 410 is provided with a first blade supporting portion 420 and a second blade supporting portion 430 which project from the developing device frame 310 and which are provided for supporting the doctor blade 36 with an interval therebetween. Further, the blade mounting surface 410*s* is constituted by a first blade supporting surface 420*s*, of the first blade supporting portion 420, capable of supporting the doctor blade 36 and by a second blade supporting surface 430*s*, of the second blade supporting portion 430, capable of supporting the doctor blade 36. Incidentally, a shortest distance between the developing sleeve 70 and the second blade supporting surface 430*s* is longer than a shortest distance between the developing sleeve 70 and the first blade supporting surface 420*s*.

In this embodiment, the first blade supporting surface 420*s* is formed over a substantially entire region of the maximum image region of the blade mounting surface 410*s*. Further, in this embodiment, the second blade supporting surface 420*s* is formed over a substantially entire region of the maximum image region of the blade mounting surface 410*s*. As a result, the attitude of the doctor blade 36 which is supported by the first blade supporting surface 420*s* and the second blade supporting surface 430*s* and which is mounted on the blade supporting portion 410 can be stabilized. Incidentally, when each of the first blade supporting surface 420*s* and the second blade supporting surface 430*s* is formed over a region which is 90% or more of the maximum image region of the blade mounting surface 410*s*, the associated blade supporting surface is regarded as being formed over the substantially entire region of the maximum image region of the blade mounting surface 410*s*.

In the example of FIGS. 18 and 19, a groove portion 440 as a recessed portion recessed from each of the first blade supporting surface 420*s* and the second blade supporting surface 430*s* by 0.2 mm or more is formed between the first blade supporting portion 420 and the second blade supporting portion 430. The groove portion 440 performs a function as a predetermined space for storing the adhesive (excessive adhesive) A escaping to the outside of the surface on which the adhesive A is applied when the doctor blade 36 is mounted on the blade mounting portion 410.

In this embodiment, the groove portion 440 is formed over the substantially entire region of the maximum image region of the blade mounting surface 410*s*. Incidentally, when the groove portion 440 is formed over a region which is 90% or more of the maximum image region of the blade mounting surface 410*s*, the groove portion 440 is regarded as being formed over the substantially entire region of the maximum image region of the blade mounting surface 410*s*. Further, in this embodiment, the adhesive A is applied on the second blade supporting surface 430*s* positioned on a side remote from the developing sleeve 70, but is not applied on the first blade supporting surface 420*s* positioned on a side close to the developing sleeve 70.

In this embodiment, for example, a widthwise length of the second blade supporting surface 430*s* is 1.5 mm, and a height of the adhesive A applied onto the second blade supporting surface 430*s* is 800 μm. Further, in this embodiment, for example, an interval between the first blade supporting portion 420 and the second blade supporting portion 430 (i.e., a width of the groove portion 440) is 3.5 mm. Further, in this embodiment, for example, an amount of a recess (i.e., a depth of the groove portion 440) from the blade mounting surface 410*s* (from each of the first blade supporting surface 420*s* and the second blade supporting surface 430*s*) is 0.4 mm. Further, in this embodiment, for example, predetermined pressure is applied to the doctor blade 36 until when the doctor blade 36 is mounted on the blade mounting portion 410 (during adhesive bonding), a film thickness of the cured adhesive is about 20-100 μm which is a film thickness capable of ensuring sufficient adhesive strength.

In this embodiment as described above, a volume of the groove portion 440 is larger than a volume of the adhesive A applied on the second blade supporting surface 430*s*. Specifically, a total value of an area of a region where the adhesive A is applied on the blade mounting surface 410*s* (the second blade supporting surface 430*s* in this embodiment) is $S_1$ ($mm^2$), and a film thickness of the adhesive A when the adhesive A applied on the second blade supporting surface 430*s* is cured is t (mm). At this time, a volume of the adhesive A applied on the second blade supporting surface 430*s* is $S_1 \times t$ ($mm^3$). Further, a longitudinal length of the groove portion 440 is L (mm), and a cross-sectional area of the groove portion 440 in a cross section perpendicular to the rotational axis of the developing sleeve 70 is $S_2$ ($mm^2$). At this time, a volume of the groove portion 440 is $S_2 \times L$ ($mm^3$). Further, by satisfying a relationship of $S_2 \times L$ ($mm^3$)$>S_1 \times t$ ($mm^3$), this relationship means that the volume of the groove portion 440 is larger than the volume of the adhesive A applied on the second blade supporting surface 430*s*.

By satisfying such a relationship, even if all the adhesive A which is applied on the blade mounting surface 410*s* (the second blade supporting surface 430*s* in this embodiment) and which has the predetermined (film) thickness escapes to the outside of the second blade supporting surface 430*s*, all the adhesive A is stored in the groove portion 440. Therefore, the excessive adhesive does not enter the inside of the developing device frame 310, so that there is no liability that a flow of the developer fed toward the SB gap G fluctuates especially due to deposition and curing of the adhesive A on the developer guiding portion 35.

Incidentally, in order to suppress that the excessive adhesive enters the inside of the developing device frame 310, the adhesive A is applied on the second blade supporting surface 430*s* positioned on the side remote from the developing sleeve 70, but it is desirable that the adhesive A is not applied on the first blade supporting surface 420*s* close to the developing sleeve 70. This is because in the case where the adhesive A is applied on the first blade supporting surface 420*s*, when the doctor blade 36 is mounted on the blade mounting portion 410, there is a possibility that a part of the adhesive escaping to the outside of the first blade supporting surface 420*s* enters the inside of the developing device frame 310. On the other hand, in the case where the doctor blade 36 is mounted on the blade mounting portion 410, even when all the adhesive A which is applied on the second blade supporting surface 430*s* and which has the predetermined thickness escapes to the outside of the second blade supporting surface 430*s*, all the adhesive A is stored in the groove portion 440. For this reason, when the doctor blade 36 is mounted on the blade mounting portion 410 (during adhesive bonding), it is possible to suppress that the adhesive escaping to the outside of the second blade supporting surface 430*s* enters the inside of the developing device frame 310.

Fourth Embodiment

In the Third Embodiment described above, the example in which the groove portion for forming the predetermined space for storing the adhesive (excessive adhesive) escaping to the outside of the adhesive A applied surface when the doctor blade is mounted on the blade mounting portion is provided on the blade mounting portion side was described. On the other hand, in this embodiment, an example in which a groove portion for forming a predetermined space for storing the adhesive (excessive adhesive) escaping to the outside of the adhesive A applied surface when the doctor blade is mounted on the blade mounting portion is provided on the doctor blade side will be described.

Figure 20:
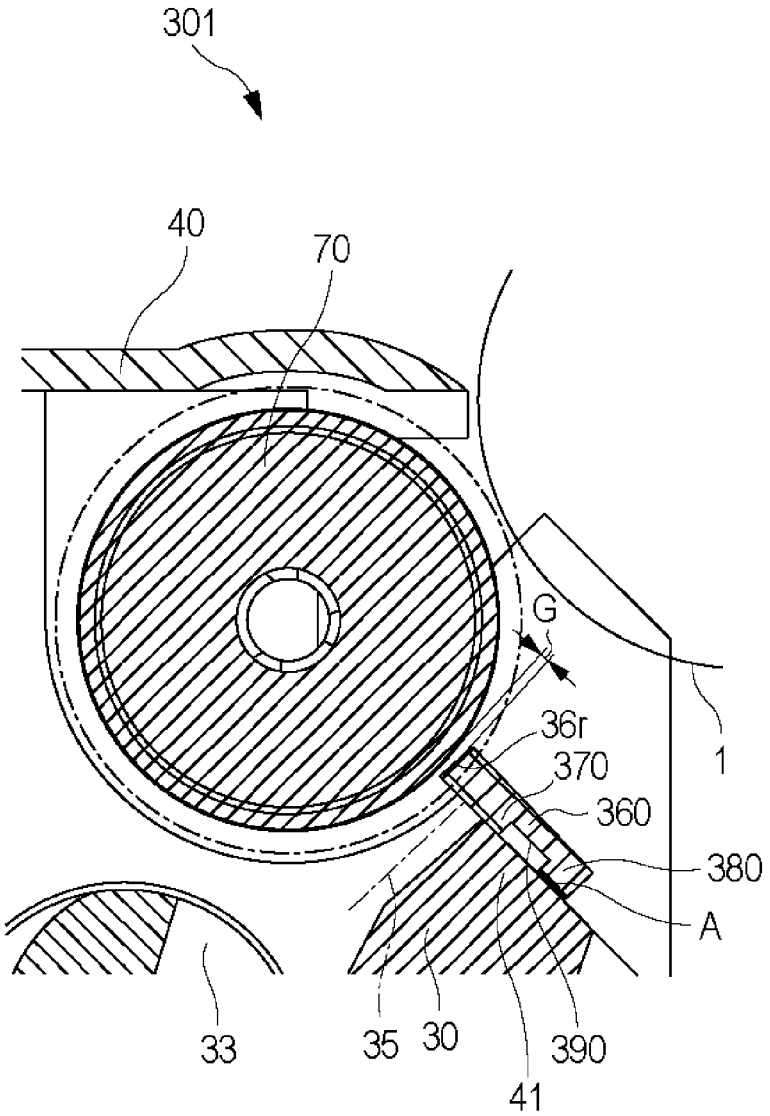
FIG. 20 is a sectional view showing a structure of a developing device according to a Fourth Embodiment.
Figure 21:
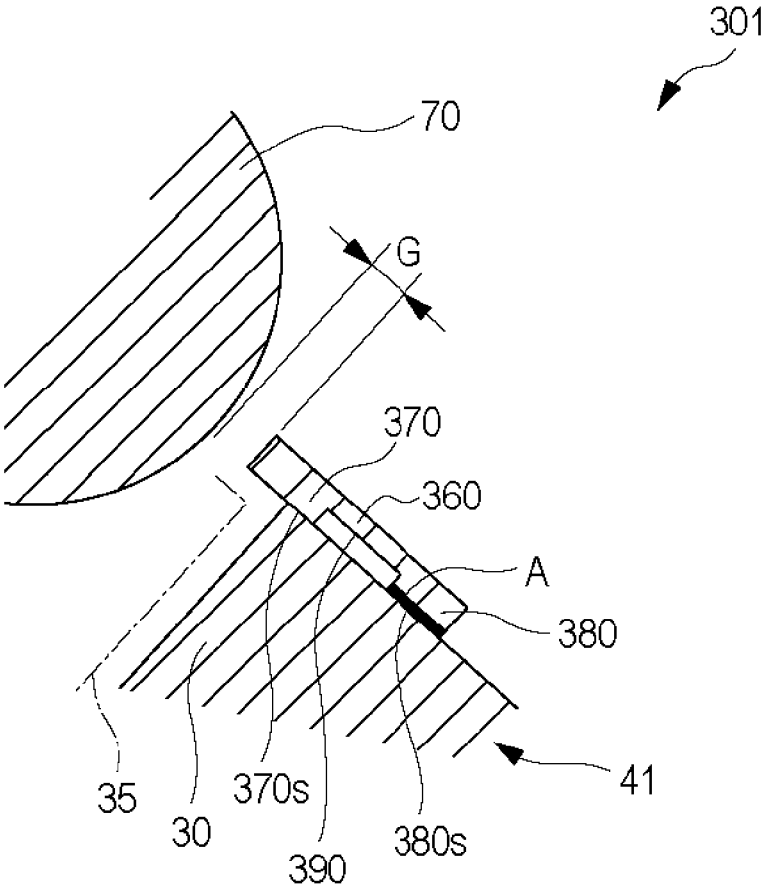
FIG. 21 is a sectional view (enlarged view) showing the structure of the developing device according to the Fourth Embodiment.

A constitution of a developing device according to this embodiment will be described using a sectional view of FIG. 20 and a sectional view (enlarged view) of FIG. 21. FIG. 20 is the sectional view of a developing device 301 in a cross section perpendicular to the rotational axis of the developing sleeve 70. FIG. 21 is the sectional view of the developing device 301 in the cross section perpendicular to the rotational axis of the developing sleeve 70 and is the enlarged view of the developing device 301 in the neighborhood of the blade mounting portion 41 (especially, the blade mounting surface 41*s*) of a developing device frame 30. In FIGS. 20 and 21, constituent elements to which the same reference numerals or symbols as those in FIGS. 4, 18 and 19 are added are the same as those in FIGS. 4, 18 and 19. In the constitution of the developing device 301 according to this embodiment, a difference from the constitution of the developing device 300 described above with reference to FIGS. 4, 18 and 19 will be principally described.

A doctor blade 360 is provided with a first blade contact portion (first portion-to-be-supported) 370 and a second blade contact portion (second portion-to-be-supported) 380 which are portions where the doctor blade 360 contacts the blade mounting portion 41 when the doctor blade 360 is mounted on the blade mounting portion 41 and which are provided with an interval therebetween. Incidentally, a shortest distance between the developing sleeve 70 and the second blade contact portion 380 is longer than a shortest distance between the developing sleeve 70 and the first blade contact portion 370.

As shown in FIGS. 20 and 21, a groove portion 390 as a recessed portion recessed from each of the first blade contact surface (first surface-to-be-supported) 370*s* and the second blade contact surface (second surface-to-be-supported) 380*s* by 0.2 mm or more is formed between the first blade contact portion 370 and the second blade contact portion 380. The first blade contact surface 370*s* is a surface of the first blade contact portion 370 contacting the blade mounting portion 41, and the second blade contact surface 380*s* is a surface of the second blade contact portion 380 contacting the blade mounting portion 410. The groove portion 390 performs a function as a predetermined space for storing the adhesive (excessive adhesive) A escaping to the outside of the surface on which the adhesive A is applied when the doctor blade 360 is mounted on the blade mounting portion 41.

In this embodiment, the groove portion 390 is formed over the substantially entire region of the maximum image region of the doctor blade 360. Incidentally, when the groove portion 390 is formed over a region which is 90% or more of the maximum image region of the doctor blade 360, the groove portion 390 is regarded as being formed over the substantially entire region of the maximum image region of the doctor blade 360. Further, in this embodiment, the adhesive A is applied on the second blade contact surface 380*s* positioned on a side remote from the developing sleeve 70, but is not applied on the first blade contact surface 370*s* positioned on a side close to the developing sleeve 70.

In this embodiment as described above, a volume of the groove portion 390 is larger than a volume of the adhesive A applied on the second blade contact surface 380*s*.

By satisfying such a relationship, even if all the adhesive A which is applied on the doctor blade 360 (the second blade contact surface 380*s* in this embodiment) and which has the predetermined (film) thickness escapes to the outside of the second blade contact surface 380*s*, all the adhesive A is stored in the groove portion 390. Therefore, the excessive adhesive does not enter the inside of the developing device frame 30, so that there is no liability that a flow of the developer fed toward the SB gap G fluctuates especially due to deposition and curing of the adhesive A on the developer guiding portion 35.

Incidentally, in order to suppress that the excessive adhesive enters the inside of the developing device frame 30, the adhesive A is applied on the second blade contact surface 380*s* positioned on the side remote from the developing sleeve 70, but it is desirable that the adhesive A is not applied on the first blade contact surface 370*s* close to the developing sleeve 70. This is because in the case where the adhesive A is applied on the first blade contact surface 370*s*, when the doctor blade 360 is mounted on the blade mounting portion 41, there is a possibility that a part of the adhesive escaping to the outside of the first blade contact surface 370*s* enters the inside of the developing device frame 30. On the other hand, in the case where the doctor blade 360 is mounted on the blade mounting portion 41, even when all the adhesive A which is applied on the second blade contact surface 380*s* and which has the predetermined thickness escapes to the outside of the second blade contact surface 380*s*, all the adhesive A is stored in the groove portion 390. For this reason, when the doctor blade 360 is mounted on the blade mounting portion 41 (during adhesive bonding), it is possible to suppress that the adhesive escaping to the outside of the second blade contact surface 380*s* enters the inside of the developing device frame 30.

Fifth Embodiment

In this embodiment, an example in which a groove portion for forming a predetermined space for storing the adhesive (excessive adhesive) escaping to the outside of the adhesive A applied surface when the doctor blade is mounted on the blade mounting portion is provided on both of the blade mounting portion side and the doctor blade side will be described.

Figure 22:
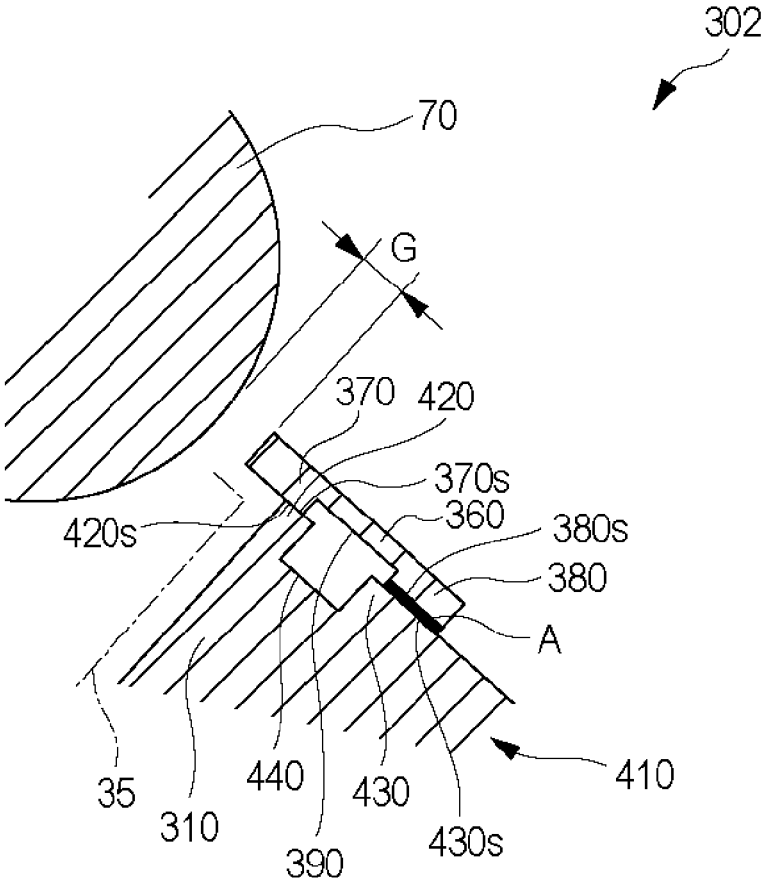
FIG. 22 is a sectional view (enlarged view) showing a structure of a developing device according to a Fifth Embodiment.

A constitution of a developing device according to this embodiment will be described using a sectional view (enlarged view) of FIG. 22. FIG. 22 is the sectional view of a developing device 302 in the cross section perpendicular to the rotational axis of the developing sleeve 70 and is the enlarged view of the developing device 302 in the neighborhood of the blade mounting portion 410 (especially, the blade mounting surface 410*s*) of a developing device frame 310. In FIG. 22, constituent elements to which the same reference numerals or symbols as those in FIGS. 19 and 21 are added are the same as those in FIGS. 19 and 21. In the constitution of the developing device 302 according to this embodiment, a difference from the constitution of the developing devices 300 and 301 described above with reference to FIGS. 19 and 21, respectively, will be principally described.

In this embodiment, as shown in FIG. 22, a groove portion 440 as a recessed portion recessed from each of the first blade supporting surface 420*s* and the second blade supporting surface 430*s* by 0.2 mm or more is formed between the first blade supporting portion 420 and the second blade supporting portion 430. Further, in this embodiment, as shown in FIG. 22, a groove portion 390 as a recessed portion recessed from each of the first blade contact surface (first surface-to-be-supported) 370*s* and the second blade contact surface (second surface-to-be-supported) 380*s* by 0.2 mm or more is formed between the first blade contact portion (first portion-to-be-supported) 370 and the second blade contact portion (second portion-to-be-supported) 380. Further, each of the groove portion 440 and the groove portion 390 performs a function as a predetermined space for storing the adhesive (excessive adhesive) A escaping to the outside of the surface on which the adhesive A is applied when the doctor blade 360 is mounted on the blade mounting portion 410.

In this embodiment, the groove portion 440 of the blade mounting portion 410 is formed over the substantially entire region of the maximum image region of the blade mounting surface 410*s*, and the groove portion 390 of the doctor blade 360 is formed over the substantially entire region of the maximum image region of the doctor blade 360. Further, the adhesive A is applied on the second blade supporting surface 430*s* and the second blade contact surface 380*s* which are positioned on a side remote from the developing sleeve 70, but is not applied on the first blade supporting surface 420*s* and the first blade contact surface 370*s* which are positioned on a side close to the developing sleeve 70.

In this embodiment as described above, a total volume of the groove portion 440 of the blade mounting portion 410 and the groove portion 390 is larger than a total volume of the adhesive A applied on the second blade supporting surface 430*s* and the second blade contact surface 380*s*.

By satisfying such a relationship, even if all the adhesive A applied on the second blade supporting surface 430*s* and the second blade contact surface 380*s* escapes to the outside of the second blade supporting surface 430*s* and the second blade contact surface 380*s*, all the adhesive A is stored in the groove portion 440 and the groove portion 390. Therefore, the excessive adhesive does not enter the inside of the developing device frame 310, so that there is no liability that a flow of the developer fed toward the SB gap G fluctuates especially due to deposition and curing of the adhesive A on the developer guiding portion 35.

Sixth Embodiment

In the Third and Fifth Embodiments, an example in which a groove portion for forming a predetermined space for storing the adhesive (excessive adhesive) escaping to the outside of the adhesive A applied surface when the doctor blade is mounted on the blade mounting portion is provided on either one or both of the blade mounting portion side and the doctor blade side was described.

On the other hand, in this embodiment, the groove portion for forming the predetermined space for storing the excessive adhesive is not provided in advance on any of the blade mounting portion and the doctor blade. Instead, in this embodiment, an example in which a predetermined space for storing the adhesive (excessive adhesive) A escaping to the outside of the adhesive applied surface is first formed when the doctor blade is mounted on the blade mounting portion will be described.

Figure 23:
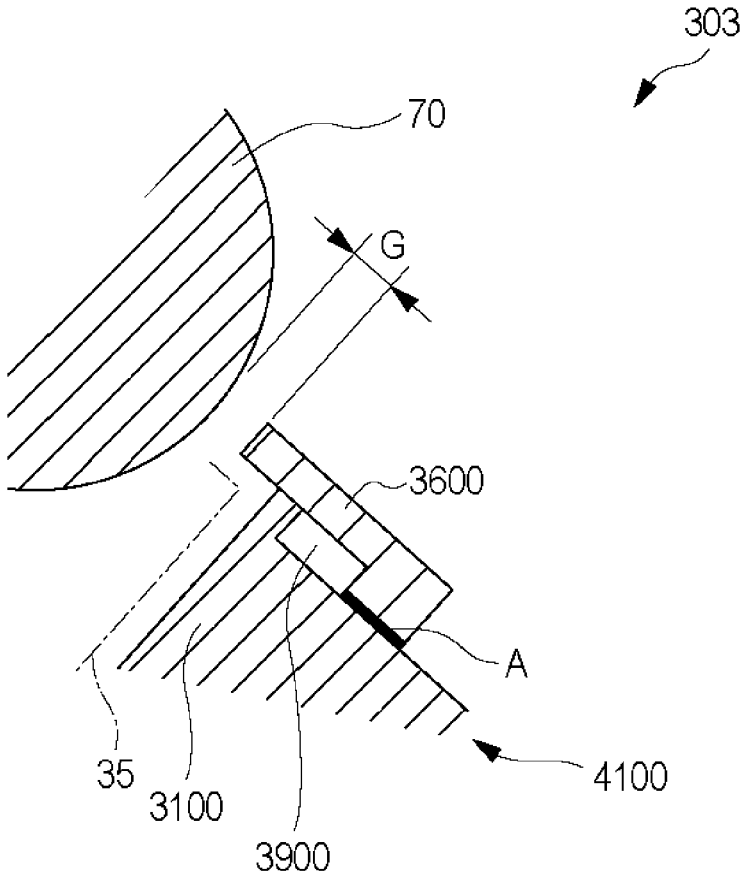
FIG. 23 is a sectional view (enlarged view) showing a structure of a developing device according to a Sixth Embodiment.

A constitution of a developing device 303 according to this embodiment will be described using a sectional view (enlarged view) of FIG. 23. FIG. 23 is the sectional view of the developing device 303 in the cross section perpendicular to the rotational axis of the developing sleeve 70 and is the enlarged view of the developing device 303 in the neighborhood of the a blade mounting portion 4100 (especially, the blade mounting surface) of a developing device frame 3100. In FIG. 23, constituent elements to which the same reference numerals or symbols as those in FIGS. 19, 21 and 22 are added are the same as those in FIGS. 19, 21 and 22. In the constitution of the developing device 303 according to this embodiment, a difference from the constitution of the developing devices 300, 301 and 302 described above with reference to FIGS. 19, 21 and 22, respectively, will be principally described.

As shown in FIG. 23, by mounting the a doctor blade 3600 on the blade mounting portion 4100, a predetermined space 3900 for storing the adhesive escaping to the outside of the adhesive applied surface is first formed between the blade mounting portion 4100 and the doctor blade 3600. In this embodiment, a volume of the predetermined space 3900 for storing the excessive adhesive is larger than a volume of the adhesive applied on the blade mounting portion 4100 and the doctor blade 3600.

By satisfying such a relationship, even if all the adhesive A applied on the blade mounting portion 4100 and the doctor blade 3600 escapes to the outside of the adhesive A applied surface, all the adhesive A is stored in the predetermined space 3900 for storing the excessive adhesive. Therefore, the excessive adhesive does not enter the inside of the developing device frame 3100, so that there is no liability that a flow of the developer fed toward the SB gap G fluctuates especially due to deposition and curing of the adhesive A on the developer guiding portion 35.

Other Embodiments

The present invention is not limited to the above-described embodiments, and various modifications (including organic combinations of the respective embodiments) can be made on the basis of the intent of the present invention and are not excluded from the scope of the present invention.

For example, it is possible to organically combine the invention according to the First Embodiment with the invention according to the Third Embodiment. That is, in a developing device in which the invention according to the First Embodiment and the invention according to the Third Embodiment are organically combined with each other, a technical feature constituting the invention according to the First Embodiment and a technical feature constituting the invention according to the Third Embodiment are included.

Further, for example, it is possible to organically combine the invention according to the First Embodiment with the invention according to the Fifth Embodiment. That is, in a developing device in which the invention according to the First Embodiment and the invention according to the Third Embodiment are organically combined with each other, a technical feature constituting the invention according to the First Embodiment and a technical feature constituting the invention according to the Fifth Embodiment are included.

Further, for example, it is possible to organically combine the invention according to the Second Embodiment with the invention according to the Fourth Embodiment. That is, in a developing device in which the invention according to the Second Embodiment and the invention according to the Fourth Embodiment are organically combined with each other, a technical feature constituting the invention according to the Second Embodiment and a technical feature constituting the invention according to the Fourth Embodiment are included.

Further, for example, it is possible to organically combine the invention according to the Second Embodiment with the invention according to the Fifth Embodiment. That is, in a developing device in which the invention according to the Second Embodiment and the invention according to the Fifth Embodiment are organically combined with each other, a technical feature constituting the invention according to the Second Embodiment and a technical feature constituting the invention according to the Fifth Embodiment are included.

In the above-described embodiments, as shown in FIG. 1, the image forming apparatus 60 having a constitution in which the intermediary transfer belt 61 is used as the intermediary transfer member was described as an example, but the present invention is not limited thereto. The present invention is also applicable to an image forming apparatus having a constitution in which transfer of the image is carried out by causing a recording material to directly contact the photosensitive drum 1 successively.

Further, in the above-described embodiments, the developing device 300 was described as a single unit, but a similar effect can be obtained even in the form of a process cartridge which is prepared by integrally assembling the image forming portion 600 (FIG. 1) including the developing device 300 into a unit and which is detachably mountable to the image forming apparatus 60. Further, when the image forming apparatus 60 includes the developing device 300 or the process cartridge, the present invention is applicable irrespective of a monochromatic (image forming) machine and a color (image forming) machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2017-224976 filed on Nov. 22, 2017, 2017-224977 filed on Nov. 22, 2017 and 2018-190016 filed on Oct. 5, 2018, which are hereby incorporated by reference herein in their entirety.

What is claimed is:

1. A developing device comprising:

a rotatable developer carrying member configured to carry a developer comprising toner and a carrier for developing an electrostatic latent image formed on an image bearing member;

a regulating blade made of a resin material and provided opposed to said rotatable developer carrying member in non-contact with said rotatable developer carrying member, said regulating blade being configured to regulate an amount of the developer carried on said rotatable developer carrying member; and a developer accommodating frame for accommodating the developer, said developer accommodating frame being made of a resin material, said developer accommodating frame being provided separately from said regulating blade, said regulating blade being fixed to said developer accommodating frame, wherein said developer accommodating frame includes a first rib which projects from said developer accommodating frame and a second rib which projects from said developer accommodating frame, each of said first rib and said second rib projects from said developer accommodating frame by 0.2 mm or more, each of said first rib and said second rib extending along a rotational axis direction of said rotatable developer carrying member, each of said first rib and said second rib being provided over a maximum image region in which an image is formable on the image bearing member, wherein when said developing device is seen in a cross section perpendicular to a rotational axis of said rotatable developer carrying member, each of said first rib and said second rib is provided at a predetermined gap therebetween in a direction from a position where said regulating blade is closest to said rotatable developer carrying member toward a rotation center of said rotatable developer carrying member, and said first rib has a first supporting surface for supporting said regulating blade, and said second rib has a second supporting surface for supporting said regulating blade, the length of each of said first supporting surface and said second supporting surface is 3.0 mm or less with respect to the direction, and wherein in a state that said regulating blade is supported by both of said first supporting surface and said second supporting surface, said regulating blade is fixed to said developer accommodating frame over the maximum image region in which an image is formable on the image bearing member.

2. A developing device according to claim 1, wherein said regulating blade is fixed to said developer accommodating frame, with an adhesive, over the maximum image region in which an image is formable on the image bearing member, wherein when said developing device is seen in the cross section perpendicular to the rotational axis of said rotatable developer carrying member, a predetermined space in which an adhesive is capable of being stored is formed between said first rib and said second rib with respect to the direction, and wherein the predetermined space is formed over the maximum image region of the image bearing member.

3. A developing device according to claim 1, wherein a shortest distance between said rotatable developer carrying member and said second supporting surface with respect to the direction is longer than a shortest distance between said rotatable developer carrying member and said first supporting surface with respect to the direction, and wherein in a state that said regulating blade is supported, with an adhesive, by said second supporting surface and said regulating blade is supported, without an adhesive, by said first supporting surface, said regulating blade is fixed to said developer accommodating frame with an adhesive over the maximum image region in which an image is formable on the image bearing member.

4. A developing device according to claim 1, wherein said developer accommodating frame has a basis thickness of 1.0 mm or more and 3.0 mm or less, and wherein when said developing device is seen in the cross section perpendicular to the rotational axis of said rotatable developer carrying member, the length of each of said first supporting surface and said second supporting surface with respect to the direction is not more than the basis thickness of said developer accommodating frame.

5. A developing device according to claim 1, wherein when said developing device is seen in the cross section perpendicular to the rotational axis of said rotatable developer carrying member, the length of each of said first supporting surface and said second supporting surface with respect to the direction is 0.7 mm or more.

6. A developing device according to claim 5, wherein the length of each of said first supporting surface and said second supporting surface with respect to the direction is 1.0 mm or more.

7. A developing device according to claim 1, wherein in a state that said regulating blade is flexed so that a gap between said rotatable developer carrying member and said regulating blade falls within a predetermined range over the maximum image region in which an image is formable on the image bearing member, said regulating blade is fixed to said developer accommodating frame with an adhesive over the maximum image region in which an image is formable on the image bearing member.

8. A developing device comprising:

a rotatable developer carrying member configured to carry a developer comprising toner and a carrier for developing an electrostatic latent image formed on an image bearing member;

a regulating blade made of a resin material and provided opposed to said rotatable developer carrying member in non-contact with said rotatable developer carrying member, said regulating blade being configured to regulate an amount of the developer carried on said rotatable developer carrying member, said regulating blade including a base portion and a regulating portion, the regulating portion being provided at a position thereof closest to said regulating blade, the regulating portion being configured to regulate the amount of the developer carried on said rotatable developer carrying member; and a developer accommodating frame for accommodating the developer, said developer accommodating frame being made of a resin material, said developer accommodating frame being provided separately from said regulating blade, said regulating blade being fixed to said developer accommodating frame, wherein said regulating blade includes a first rib which projects from said base portion and a second rib which projects from said base portion, each of said first rib and said second rib projects from said base portion by 0.2 mm or more, each of said said first rib and said second rib extending along a rotational axis direction of said rotatable developer carrying member, each of said first rib and said second rib being provided over a maximum image region in which an image is formable on the image bearing member, wherein when said developing device is seen in a cross section perpendicular to a rotational axis of said rotatable developer carrying member, each of said first rib and said second rib is provided at a predetermined gap therebetween in a direction from a position where said regulating blade is closest to said rotatable developer carrying member toward a rotation center of said rotatable developer carrying member, and said first rib has a first surface-to-be-supported supported by said developer accommodating frame, and said second rib has a second surface-to-be-supported supported by said developer accommodating frame, the length of each of said first surface-to-be-supported and said second surface-to-be-supported is 3.0 mm or less with respect to the direction, and wherein in a state that both of said first surface-to-be-supported and said second surface-to-be-supported are supported by said developer accommodating frame, said regulating blade is fixed to said developer accommodating frame over the maximum image region in which an image is formable on the image bearing member.

9. A developing device according to claim 8, wherein said regulating blade is fixed to said developer accommodating frame, with an adhesive, over the maximum image region in which an image is formable on the image bearing member, wherein when said developing device is seen in the cross section perpendicular to the rotational axis of said rotatable developer carrying member, a predetermined space in which an adhesive is capable of being stored is formed between said first rib and said second rib with respect to the direction, and wherein the predetermined space is formed over the maximum image region in which an image is formable on the image bearing member.

10. A developing device according to claim 8, wherein a shortest distance between said rotatable developer carrying member and said second surface-to-be-supported with respect to the direction is longer than a shortest distance between said rotatable developer carrying member and said first surface-to-be-supported with respect to the direction, and wherein in a state that said second surface-to-be-supported surface is supported, with an adhesive, by said developer accommodating frame and said first surface-to-be-supported surface is supported, without an adhesive, by said developer accommodating frame, said regulating blade is fixed to said developer accommodating frame, with an adhesive, over the maximum image region in which an image is formable on the image bearing member.

11. A developing device according to claim 8, wherein said developer accommodating frame has a basis thickness of 1.0 mm or more and 3.0 mm or less, and wherein when said developing device is seen in the cross section perpendicular to the rotational axis of said rotatable developer carrying member, the length of each of said first surface-to-be-supported and said second surface-to-be-supported with respect to the direction is not more than the basis thickness of said developer accommodating frame.

12. A developing device according to claim 8, wherein when said developing device is seen in the cross section perpendicular to the rotational axis of said rotatable developer carrying member, the length of each of said first surface-to-be-supported and said second surface-to-be-supported with respect to the direction is 0.7 mm or more.

13. A developing device according to claim 12, wherein the length of each of said first surface-to-be-supported and said second surface-to-be-supported with respect to the direction is 1.0 mm or more.

14. A developing device according to claim 8, wherein in a state that said regulating blade is flexed so that a gap between said rotatable developer carrying member and said regulating blade falls within a predetermined range the maximum image region in which an image is formable on the image bearing member, said regulating blade is fixed to said developer accommodating frame with an adhesive over the maximum image region in which an image is formable on the image bearing member.

15. A developing device comprising:

a rotatable developer carrying member configured to carry a developer comprising toner and a carrier for developing an electrostatic latent image formed on an image bearing member;

a regulating blade made of a resin material and provided opposed to said rotatable developer carrying member in non-contact with said rotatable developer carrying member, said regulating blade being configured to regulate an amount of the developer carried on said rotatable developer carrying member; and a developer accommodating frame for accommodating the developer, said developer accommodating frame being made of a resin material, said developer accommodating frame being provided separately from said regulating blade and including a fixing portion configured to fix said regulating blade, wherein said regulating blade is fixed to said fixing portion, with an adhesive, in a region thereof corresponding to a maximum image region in which an image is formable on the image bearing member, wherein when said developing device is seen in the cross section perpendicular to the rotational axis of said rotatable developer carrying member, a predetermined space in which an adhesive is capable of being stored is formed between said fixing portion and said regulating blade, and wherein the predetermined space is formed in a region of said fixing portion corresponding to the maximum image region in which an image is formable on the image bearing member.

16. A developing device according to claim 15, wherein said regulating blade is fixed to said fixing portion, with the an adhesive, over the maximum image region in which an image is formable on the image bearing member, and wherein the predetermined space is formed over the maximum image region in which an image is formable on the image bearing member.

17. A developing device according to claim 15, wherein in a state that said regulating blade is flexed so that a gap between said rotatable developer carrying member and said regulating blade falls within a predetermined range over the maximum image region in which an image is formable on the image bearing member, said regulating blade is fixed to said fixing portion, with an adhesive, over the maximum image region in which an image is formable on the image bearing member.

18. A developing device comprising:

a rotatable developer carrying member configured to carry a developer comprising toner and a carrier for developing an electrostatic latent image formed on an image bearing member;

a regulating blade made of a resin material and provided opposed to said rotatable developer carrying member in non-contact with said rotatable developer carrying member, said regulating blade being configured to regulate an amount of the developer carried on said rotatable developer carrying member; and a developer accommodating frame for accommodating the developer, said developer accommodating frame being provided separately from said regulating blade and including a fixing portion configured to fix said regulating blade, wherein said regulating blade is fixed to said fixing portion, with an adhesive, in a region thereof corresponding to a maximum image region in which an image is formable on the image bearing member, wherein when said developing device is seen in the cross section perpendicular to the rotational axis of said rotatable developer carrying member, a predetermined space in which an adhesive is capable of being stored is formed between said fixing portion and said regulating blade, and wherein the predetermined space is formed in a region of said regulating blade corresponding to the maximum image region in which an image is formable on the image bearing member.

19. A developing device according to claim 18, wherein said regulating blade is fixed to said fixing portion, with an adhesive, over the maximum image region in which an image is formable on the image bearing member, and wherein the predetermined space is formed over the maximum image region in which an image is formable on the image bearing member.

20. A developing device according to claim 19, wherein in a state that said regulating blade is flexed so that a gap between said rotatable developer carrying member and said regulating blade falls within a predetermined range over the the maximum image region in which an image is formable on the image bearing member, said regulating blade is fixed to said fixing portion, with an adhesive, over maximum image region in which an image is formable on the image bearing member.

* * * * *